US006161389A

United States Patent [19]

Sekiya et al.

[11] Patent Number: 6,161,389

[45] Date of Patent: Dec. 19, 2000

[54] STIRLING MACHINE WITH HEAT EXCHANGER HAVING FIN STRUCTURE

[75] Inventors: Hiroshi Sekiya; Nobuo Koumoto; Eiji Fukuda; Takashi Inoue, all of Gunma, Japan

[73] Assignee: Sanyo Electric Co., Ltd., Osaka, Japan

[21] Appl. No.: 09/246,066

[22] Filed: Feb. 8, 1999

[30] Foreign Application Priority Data

| | | | |
|---|---|---|---|
| Feb. 6, 1998 | [JP] | Japan | 10-041235 |
| Feb. 9, 1998 | [JP] | Japan | 10-042924 |
| Feb. 9, 1998 | [JP] | Japan | 10-042925 |
| Feb. 9, 1998 | [JP] | Japan | 10-042927 |
| Feb. 16, 1998 | [JP] | Japan | 10-051571 |

[51] Int. Cl.[7] ..... F25B 9/00

[52] U.S. Cl. ..... 62/6

[58] Field of Search ..... 62/6; 60/520

[56] References Cited

U.S. PATENT DOCUMENTS

| | | | |
|---|---|---|---|
| 2,397,734 | 4/1946 | Goebel et al. | 62/6 |
| 2,764,879 | 10/1956 | DeLange | 62/6 |
| 2,784,570 | 3/1957 | Kohler | 62/6 |
| 4,458,489 | 7/1984 | Walsh | 60/520 |
| 4,967,572 | 11/1990 | Strasser | 62/467 |
| 5,435,140 | 7/1995 | Ishino et al. | 62/6 |
| 5,664,421 | 9/1997 | Matsue et al. | 62/6 |
| 5,675,974 | 10/1997 | Heikrodt et al. | 62/6 |

*Primary Examiner*—William Doerrler
*Attorney, Agent, or Firm*—Darby & Darby

[57] ABSTRACT

A fin structure for cooling cold-heat refrigerant and another fin structure (slender grooves or the like) constituting a working gas flow passage are formed on the outer and inner surfaces of the heat exchange housing constituting a low-temperature heat exchanger by a lost was casting method so that these fin structures are formed integrally with the heat exchange housing. In addition, a fin structure and another fin structure constituting a working gas flow passage are integrally formed on the outer and inner surfaces of a high-temperature side heat exchanger (heat rejector). Accordingly, the heat exchangers of a Stirling machine can be manufactured in a simple structure by the lost wax casting method, whereby the workability can be enhanced and the manufacturing cost can be reduced. In addition, the precision for the workability can be enhanced, and the heat exchange efficiency and the reliability can be enhanced.

19 Claims, 17 Drawing Sheets

STIRLING MACHINE WITH HEAT EXCHANGER HAVING FIN STRUCTURE

BACKGROUND OF THE INVENTION

1. Field of the Invention

The present invention relates to a Stirling machine which uses a heat exchanger(s) mounted in a heat engine such as Stirling-cycle equipment (a Stirling engine, a Stirling refrigerating machine, etc.), a Vuilleumier cycle machine, a Cooke-Yarbourgh cycle machine or the like, and which is applied to various industrial fields such as a food distribution industry, an environment test industry, a medical service industry, a biological industry, a semiconductor manufacturing industry, a domestic equipment industry, etc.

2. Description of the Related Art

Heat engines such as Stirling-cycle equipment (Stirling engine, Stirling refrigerating machine, etc.), a Vuilleumier cycle machine, a Cooke-Yarbourgh cycle machine, etc. have been hitherto known and disclosed in Japanese Laid-open Patent Applications No. Hei-7-293334, No. Hei-9-151792 and No. Hei-8-158939, etc.

Of these heat engines, the Stirling refrigerating machine have been particularly put on the center stage as a refrigerating machine using flon(fluorocarbon)-alternative sources which aim to avoid the recent global environmental problems, or as a compact heat engine having high performance coefficient and high energy efficiency which is usable in a wider temperature range than the conventional cooling machines, applicable to not only cold-heat using equipment such as a freezing chamber, a refrigerator, an immersion cooler, etc. for domestic use and business use, but also cold-heat using equipment in various industrial fields such as a constant-temperature liquid circulator, a low-temperature thermostat, a constant-temperature bath (thermostat), a heat shock testing apparatus, a freeze dryer, a blood/cell preserving apparatus, a cold cooler and other types of freezing/cooling apparatuses.

According to the Stirling refrigerating machine, working gas flows through a flow passage between a compression chamber (high-temperature chamber) and an expansion chamber (low-temperature chamber), and it is heat-exchanged with a cold-heat refrigerant and a heat-radiating (hot) refrigerant flowing through a cold (endothermic) heat-exchanger (low-temperature heat exchanger) and a hot (heat-radiating) heat exchanger (high-temperature heat exchanger) respectively which are disposed along the flow passage for the working gas. A shell-and-tube type heat exchanger, a plate-fin type heat exchanger, etc. have been hitherto used as the heat exchanger of the Stirling refrigerating machine.

In this specification, each of "cold heat" and "hot heat" means a kind of physical quantity associated with heat. For example, when it is described that "cold heat" is transferred to an object such as a heat exchange medium (cold-heat refrigerant) or the like, the description means that the cold-heat refrigerant is cooled. On the other hand, when it is described that "hot heat" is transferred to an object such as a heat exchange medium (hot-heat refrigerant) or the like, the description means that the hot-heat refrigerant is heated.

FIG. 1 is a front view showing a conventional shell-and-tube type heat exchanger, and FIG. 2 is a cross-sectional view taken along a line A—A of the shell-and-tube type heat exchanger shown in FIG. 1.

The conventional shell-and-tube type heat exchanger 122 shown in FIGS. 1 and 2 has an inner sleeve 123, an outer sleeve 124 and an annular flow passage 125 which is disposed between the inner sleeve 123 and the outer sleeve 124 and through which heat exchange medium such as cooling water or the like flows. Further, a number of tubes 126 through which working gas such as helium or the like for a heat engine flows are fixed through a shell 127. The shell-and-tube type heat exchanger 122 is excellent in performance, however, a long time and much labor are needed to manufacture the shell-and-tube type heat exchanger and also the manufacturing cost is high.

In order to enhance the heat exchange performance and reliability, the heat exchanger for the Stirling machine such as the Stirling refrigerating machine or the like is required to be designed so as to have a flow passage for working gas through which working gas can uniformly flow without the flow of the working gas being disturbed even partially and also fins which are uniform in thickness and designed with high precision. In addition, in order to reduce the manufacturing cost, the heat exchanger is also required to be excellent in processing and also to enable simplification of the structure of the overall Stirling machine. However, as described above, the shell-and-tube type heat exchanger needs much labor and long time in fabrication process and the manufacturing cost cannot be reduced.

SUMMARY OF THE INVENTION

The present invention has been implemented to overcome the above problems of the prior art, and has an object to provide an heat exchanger which is more excellent in performance such as heat transfer performance, etc. and in its processing and also is more easily manufactured and lower in manufacturing cost.

Another object of the present invention is to provide a compact Stirling machine using the above heat exchanger, which can be used for general purpose in a broader temperature range without using any flon (fluorocarbons) and can be detachably connected to at least one of cold-heat using equipment and hot-heat using equipment in various industrial fields to use cold-heat and hot-heat thus produced at the same time, thereby enabling effective energy use.

In order to attain the above objects, according to the present invention, a Stirling machine having a low-temperature side heat exchanger and a high-temperature side heat exchanger which perform cooling operation and heating operation through heat exchange between working gas and heat exchange medium (cold-heat exchange medium and/or hot-heat exchange medium), the low-temperature side heat exchanger comprising a top-side cylindrical heat exchange housing having a top wall and a side wall and containing therein an inner cylinder in which a piston or displacer of said Stirling machine is slid, and the high-temperature side heat exchanger comprising a cylindrical annular heat exchange housing and a heat exchanger body which is fixedly inserted in the cylindrical annular heat exchange housing to form a flow passage for the heat exchange medium between the annular heat exchange housing and the heat exchanger body, is characterized in that a fin structure is formed on at least the inner peripheral surface of at least one of the top-side heat exchange housing of said low-temperature side heat exchanger and the heat exchanger body of the high-temperature side heat exchanger, a flow passage for the working gas being formed between the fin structure and the outer peripheral surface of the inner cylinder, and at least one of said top-side heat exchange housing, the annular heat exchange housing and the heat exchanger body is formed by casting.

In the above Stirling machine, the fin structure formed on the inner peripheral surface of at least one of the top-side heat exchange housing and the heat exchanger body comprises slender grooves which are linearly formed in the axial direction of the inner cylinder, the working gas flow passage being formed between the slender grooves and the outer peripheral surface of the inner cylinder.

In the above Stirling machine, the fin structure comprises an offset strip fin which is fixed onto at least the inner peripheral surface of the heat exchanger body so as to face the working gas flow passage.

In the above Stirling machine, an offset strip fin is fixed onto the outer peripheral surface of the heat exchanger body so as to face the heat exchange medium.

In the above Stirling machine, a fin structure is further provided on the outer peripheral surface of at least one of the top-side heat exchange housing of the low-temperature side heat exchanger and the heat exchanger body of the high-temperature side heat exchanger by forming the fin structure integrally with at least one of said top-side heat exchanger and the heat exchanger body or by forming the fin structure separately and then fixing the fin structure onto the outer peripheral surface.

In the above Stirling machine, the fin structure thus integrally formed or separately formed comprises a plurality of annular fins.

The above Stirling machine further includes a cold head disposed at the tip side of the top-side heat exchange housing of the low-temperature side heat exchanger. The cold head has an heat-exchange medium flow passage designed so as to penetrate through the inside of the cold head, through which the heat exchange medium flows, and a fin structure is provided in the heat-exchange medium flow passage to enhance the heat exchange efficiency.

In the above Stirling machine, the fin structure comprises a fin strip fin.

The above Stirling machine is further provided with a cold-heat exchange medium pipe through which the heat exchange medium cooled by the low-temperature side heat exchanger (hereinafter referred to as "cold-heat exchange medium) flows, an inlet cock for the cold-heat exchange medium disposed at one end of the cold-heat exchange medium pipe and an outlet cock for the cold-heat exchange medium disposed at the other end of the cold-heat exchange medium pipe, wherein by detachably connecting the outlet cock and the inlet cock for the cold-heat exchange medium to a cold-heat exchange medium pipe of a cold-heat using equipment, a circulating pipe line for the cold-heat exchange medium is formed between the Stirling machine and the cold-heat using equipment to feed cold heat produced in the Stirling machine to the cold-heat using equipment. In this case, if the motor of the Stirling machine is reversely rotated, the hot heat can be fed to the cold-heat using equipment.

The above Stirling machine is further provided with a temperature controller for controlling the driving power of the Stirling machine on the basis of a temperature detection signal from the cold-heat using equipment to thereby perform temperature control of the cold-heat using equipment.

The above Stirling machine is further provided with a hot-heat exchange medium pipe through which the heat exchange medium heated by the high-temperature side heat exchanger (hereinafter referred to as "hot-heat exchange medium") flows, an inlet cock for the hot-heat exchange medium disposed at one end of the hot-heat exchange medium pipe and an outlet cock for the hot-heat exchange medium pipe disposed at the other end of the hot-heat exchange medium pipe, whereby by detachably connecting the outlet cock and the inlet cock for the hot-heat exchange medium to a hot-heat exchange medium pipe of a hot-heat using equipment, a circulating pipe line for the hot-heat exchange medium is formed between the Stirling machine and the hot-heat using equipment to feed hot heat to the hot-heat using equipment.

The above Stirling machine is further provided a temperature controller for controlling the driving power of the Stirling machine on the basis of a temperature detection signal from the hot-heat using equipment to perform temperature control of the hot-heat using equipment, wherein the temperature controller is provided integrally with or separately from the temperature controller for the cold-heat using equipment The above Stirling machine is further provided with a defrosting control circuit for controlling a motor of the Stirling machine to be reversely rotated to thereby defrost the cold-heat using equipment and/or the low-temperature heat exchanger when occurrence of frost on the cold-heat using equipment and/or the low-temperature heat exchanger is detected.

In the above Stirling machine, at least one of the top-side heat exchange housing, the annular heat exchange housing and the heat exchanger body is formed by a lost wax casting method.

In the above Stirling machine, the fin structure is formed integrally with at least one of the top-side heat exchange housing and the heat exchanger body by the lost wax casting method.

In the above Stirling machine, ethyl alcohol, HFE (hydrofluoroether), PFC (perfluorocarbon), PFG (perfluorogrycol), oil (for heating), nitrogen, helium, water or the like is used as the heat exchange medium, and nitrogen, helium, water or the like is used as the working gas.

DETAILED DESCRIPTION OF THE PREFERRED EMBODIMENTS

Preferred embodiments according to the present invention will be described hereunder with reference to the accompanying drawings.

Figure 1:
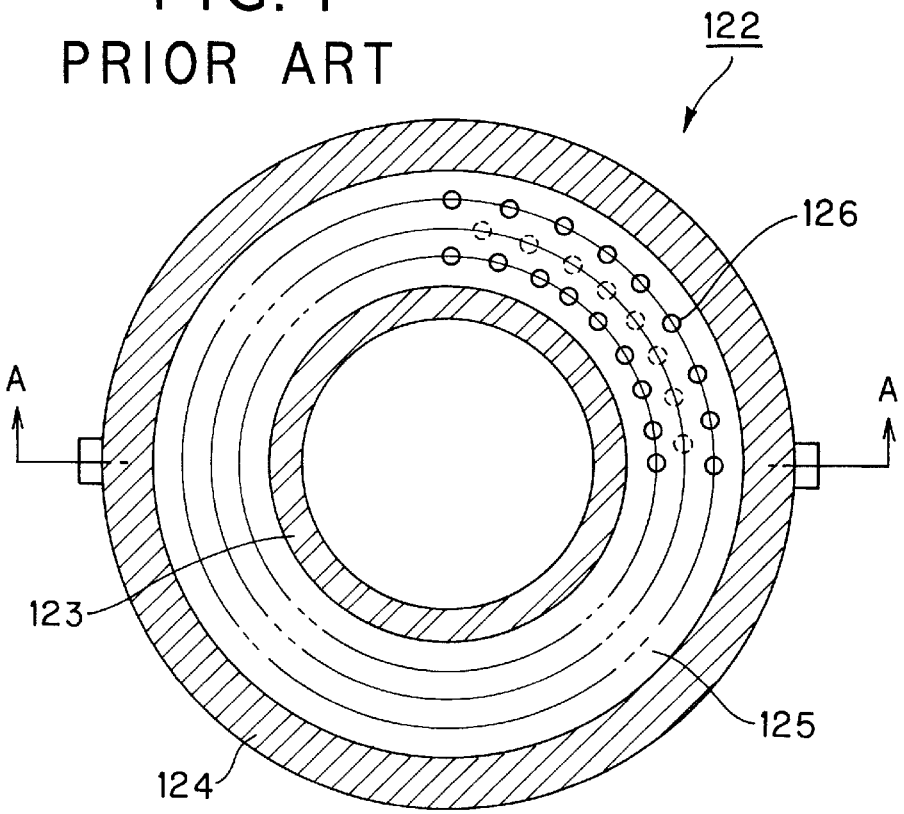
FIG. 1 PRIOR ART
FIG. 1 is a front view showing a conventional shell-and-tube type heat exchanger.
Figure 2:
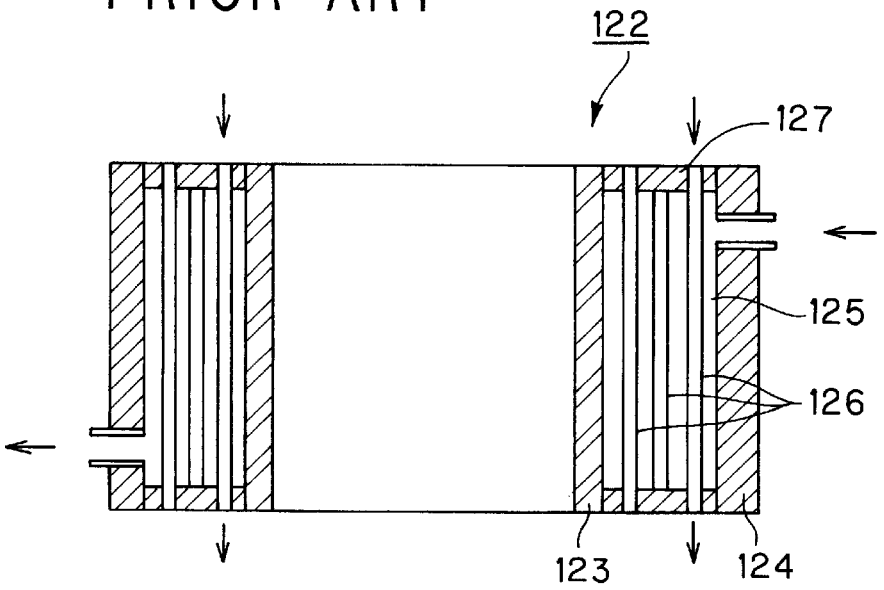
FIG. 2 PRIOR ART
FIG. 2 is a longitudinal-sectional view of the shell-and-tube type heat exchanger of FIG. 1, which is taken along a line A—A of FIG. 1.
Figure 3:
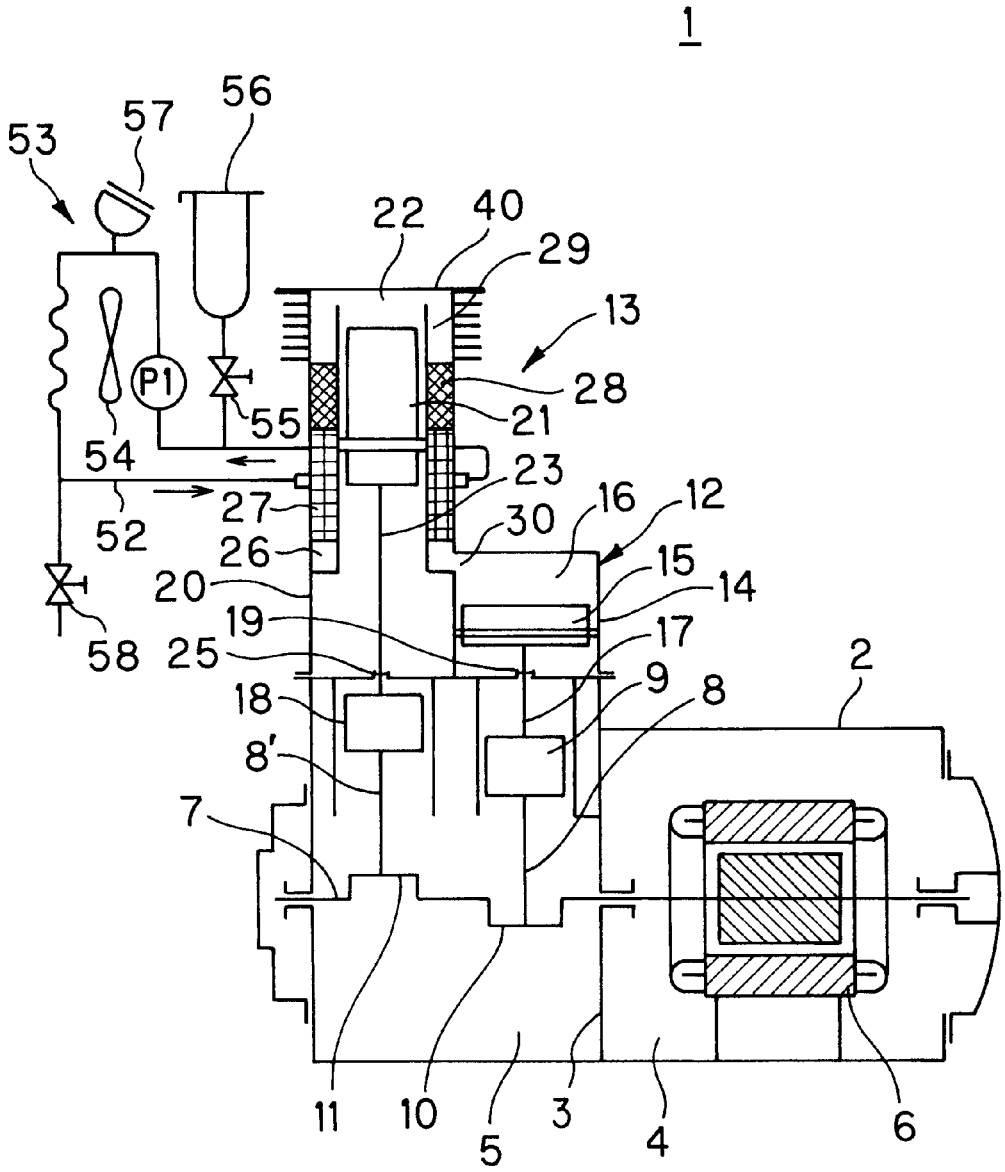
FIG. 3 is a schematic view showing the basic construction of a Stirling refrigerating machine according to the present invention.

FIGS. 3 to 7B show a first embodiment of a heat exchanger according to the present invention. FIG. 3 is an overall diagram showing a Stirling refrigerating machine 1 serving as a thermal engine to which a thermal-engine cylinder block of a heat exchanger of the present invention is applied.

The housing 2 of the Stirling refrigerating machine 1 is formed by casting, and the inside thereof is kept semi-closed. The inside of the housing 2 is partitioned into a motor compartment 4 and a crank compartment 5 through a compartment wall 3. A forwardly/reversely ratable motor 6 is disposed in the motor compartment 4, and a crank shaft for converting the rotational motion of the motor 6 to a reciprocating motion, a connecting rod (con'rod) 8 and a cross guide head 9 are disposed in the crank compartment 5. These units serve as driving means for the Stirling refrigerating machine 1 in combination.

Two crank portions 10 and 11 of the crank shaft 7 are designed so as to keep a phase shift therebetween so that the crank portion 11 moves prior to the movement of the crank portion 10 when the motor is forwardly rotated. The phase shift is generally set to about 90 degrees.

A compression cylinder 12 and an expansion cylinder are disposed at the upper portion of the crank compartment 5 so that the expansion cylinder is located at a slightly higher position than the compression cylinder 12. Working gas such as helium, hydrogen nitrogen or the like is hermetically filled in the compression cylinder 12, the expansion cylinder and the housing 2. The compression cylinder 12 has a compression cylinder block 14 fixed to the housing 2 by bolts or the like, and a compression piston is reciprocatively moved (oscillated) in the space defined by the compression cylinder block 14. The upper portion of the space (the compression space) serves as a high-temperature chamber 16, and the working gas in the high-temperature chamber 16 is compressed to be kept to high temperature.

A compression piston rod 17 links the compression piston 15 and the cross guide head 9 to each other, and it is designed to extend through an oil seal 19 between the compression cylinder 12 and the crank compartment 5. The reciprocatively-moving compression piston 15 inverts its sliding direction both at the top dead center and at the bottom dead center, and thus the moving speed thereof is equal to zero at both the top and bottom dead centers. Therefore, the moving speed of the compression piston 15 is lower and the volume variation per unit time in the cylinder is also smaller in the neighborhood of the top dead center and the bottom dead center. On the other hand, the moving speed of the compression piston 15 is maximum at the midpoint in the movement from the bottom dead center to the top dead center and at the midpoint in the movement from the top dead center to the bottom dead center, and also the volume variation per unit time due to the movement of the compression piston 15 is maximum at these midpoints.

The expansion cylinder 13 has an expansion cylinder block 20 fixed to the housing 2 by bolts or the like, and an expansion piston 21 is reciprocatively moved (oscillated) in the space of the expansion cylinder block 20. The upper portion of the space (expansion space) serves as a low-temperature chamber 22, and the working gas in the low-temperature chamber 22 is expanded to be kept to low temperature. An expansion piston rod 23 links the expansion piston 21 and the cross guide head 18, and it is designed so as to extend through an oil seal 25 between the expansion cylinder 13 and the crank compartment 5. The expansion piston 21 moves prior to the movement of the compression piston 15 with keeping a phase shift of 90 degrees.

A manifold 26 through which the working gas flows into/out of the compression space of the compression cylinder 12 is provided to the expansion cylinder block 20 so as to intercommunicate with the expansion cylinder block 20, and the heat rejector (high-temperature side heat exchanger) 27, a regenerator 28 and the heat absorber (low-temperature side heat exchanger) 29 are annularly arranged so as to successively intercommunicate with each other.

An intercommunication hold 30 through which the high-temperature chamber 16 and the manifold 26 intercommunicates with each other is formed near to the upper end of the compression cylinder block 14, whereby the high temperature chamber 16 and the low temperature chamber 22 intercommunicates with each other through the intercommunication hole 30, the manifold 26, the heat rejector 27, the regenerator 28 and the heat absorber 29 in this order.

A cylinder block for thermal engine of the heat exchanger according to this embodiment will be described by using the expansion cylinder block 20 with reference to FIGS. 4 to 7B.

Figure 4:
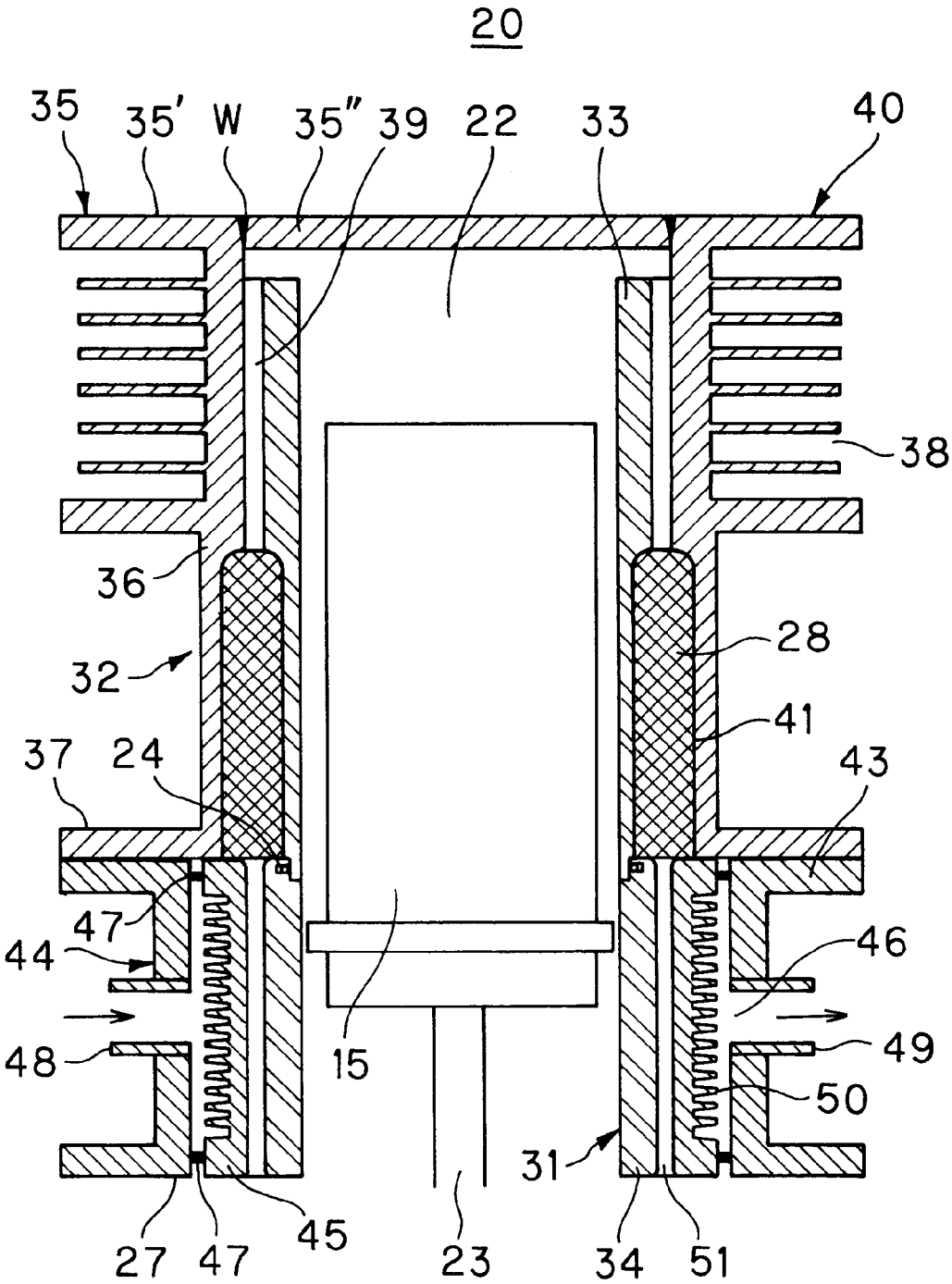
FIG. 4 is a longitudinal-sectional view showing an expansion cylinder block of a cylinder block for thermal engine which is used as a heat exchanger according to an embodiment of the present invention.

In FIG. 4, the expansion cylinder block 20 comprises an inner cylinder 31, the hot (heat radiating) heat exchanger 27 which is disposed around the outside of the lower portion of the inner cylinder 31 so as to be coaxial with the inner cylinder 31, and a low-temperature side heat exchanger (heat absorber) housing (top heat exchange housing) 32 disposed on the heat rejector 27. The inner cylinder 31 forms a cylinder space in which the expansion piston 21 is reciprocatively moved. The inner cylinder 31 is constructed by assembling an upper portion 33 and a lower portion 34 thereof through an O ring 24, however, it may be integrally manufactured.

Figure 5B:
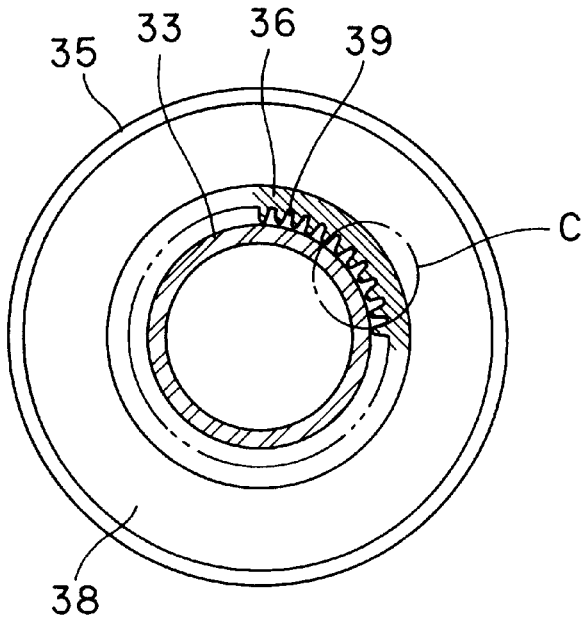
FIG. 5B is a plan view showing the low-temperature side heat exchange housing of FIG. 5A
Figure 5C:
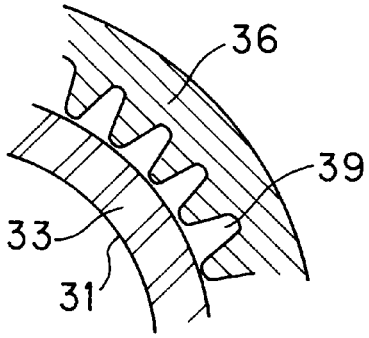
FIG. 5C is an enlarged view of the main part of the low-temperature side heat exchange housing of FIG. 5A.
Figure 5A:
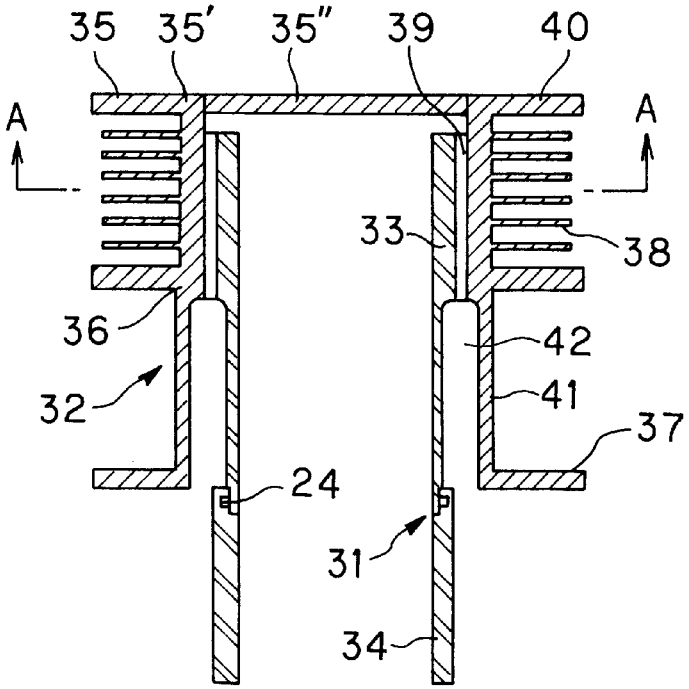
FIG. 5A is a longitudinal-sectional view showing a low-temperature side heat exchange housing (top-side heat exchange housing) of the heat exchanger of FIG. 4.

FIG. 5A shows the low-temperature side heat exchange housing 32, FIG. 5B is a cross-sectional view of the low-temperature side heat exchange housing 32 which is taken along a line A—A of FIG. 5A, and FIG. 5C is an enlarged view of the FIG. 5A.

In FIGS. 4, 5A, 5B and 5C, the low-temperature side heat exchange housing 32 is designed in a cylindrical form, and it comprises a top wall 35, a side wall 36 and a lower end flange portion 37. Fins 38 and an intermediate flange 38' are formed on the outer peripheral surface at the tip portion of the side wall 36 (at the upper side of FIG. 5A). The top wall 35 comprises a flange top wall portion 35' and a center top wall portion 35", and the center top wall portion 35" is welded to the inner surface of the top end of the side wall 36 so that the flange top wall portion 35' and the center top wall portion 35" are unified into one body. The top wall 35 may be integrally formed with the side wall 36 by a lost wax casting method.

A number of slender grooves are formed in the longitudinal direction of the low-temperature side heat exchange housing 32 on the inner peripheral surface at the tip portion of the side wall 36 so as to be disposed at predetermined intervals in the peripheral direction of the side wall 36 and brought into close contact with the outer surface of the inner cylinder 31 (FIG. 5C). The slender grooves 39 and the outer surface of the inner cylinder 31 form a flow passage for the working gas. With the above construction, the top portion of the low-temperature side heat exchange housing 32 (the cold head 40) forms the heat absorber (low-temperature side heat exchanger 29). The cold head 40 is brought into contact with cold-heat refrigerant such as air, water, alcohol or the like to cool the cold-heat refrigerant.

Further, an annular recess portion 41 is formed on the inner peripheral surface of the center portion of the low-temperature side heat exchange housing 32, and it forms an annular space 42 in cooperation with the inner cylinder 31. In the annular space 42 is formed the regenerator 28 filled with regenerator material such as metal mesh or the like. The flange portion 37 at the lower end of the low-temperature side heat exchange housing 32 is mounted on the flange portion at the upper end of the heat rejector 27.

The low-temperature side heat exchange housing 32 of this embodiment is formed of a material such as SUS group or the like by the lost wax casting method. That is, this embodiment of the present invention is characterized in that the low-temperature side heat exchange housing 32, the cooling fins 38 and the slender grooves 39 for the flow passage of the working gas are integrally formed by the lost was casting method so that the cooling fins 38 are formed on the outer peripheral surface of the low-temperature side heat exchange housing 32 and the slender grooves 39 are formed on the inner peripheral surface of the low-temperature side heat exchange housing 32.

The low-temperature side heat exchange housing 32 thus manufactured by the lost wax casting method is remarkably excellent in heat-radiation performance because the cooling fins 38 are precisely cast in a minutely-crease form on the outer surface of the low-temperature side heat exchange housing 32, and also the working gas is allowed to uniformly flow between the slender grooves 39 and the inner cylinder 31 without disturbing the flow of the working gas even partially because the slender grooves 39 are also precisely cast in the axial direction of the heat exchange housing 32. Therefore, the overall refrigerating performance of the heat exchanger can be enhanced as a whole.

In the above embodiment, the cooling fins 38 and the slender grooves 39 are formed on the outer surface and the inner surface of the low-temperature side heat exchange housing 32 integrally with the low-temperature side heat exchange housing 32 by the lost wax casting method. However, the heat exchange efficiency can be enhanced to some degree insofar as at least the slender grooves 39 are formed on the inner peripheral surface of the low-temperature side heat exchange housing 32 in the axial direction of the heat exchange housing 32.

Figure 6B:
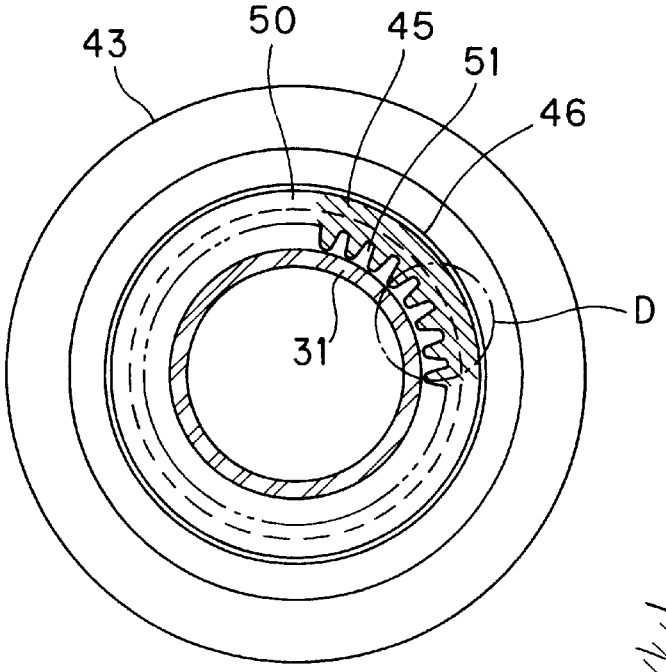
FIG. 6B is a plan view showing the high-temperature side heat exchange housing of FIG. 6A
Figure 6C:
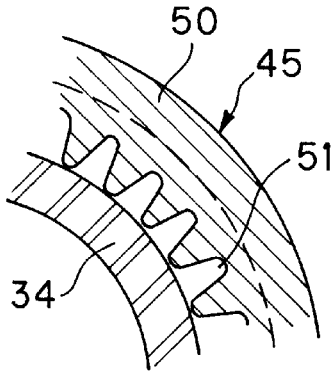
FIG. 6C is an enlarged view of the main part of the high-temperature side heat exchange housing of FIG. 6A.
Figure 6A:
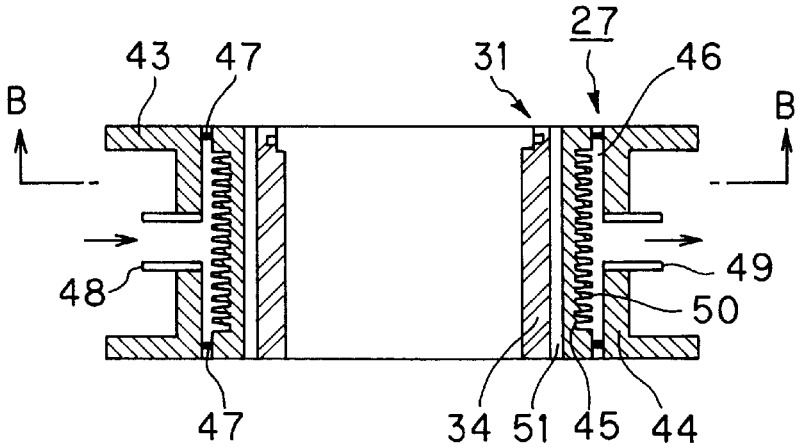
FIG. 6A is a longitudinal-sectional view showing a high-temperature heat exchange housing (annular heat exchange housing) of the heat exchanger of FIG. 4.

FIG. 6A is a longitudinal-sectional view showing the high-temperature side heat exchange housing (annular heat exchange housing) of the expansion cylinder block, FIG. 6B is a cross-sectional view taken along a line B—B of FIG. 6A, and FIG. 6C is an enlarged view of a main part D of FIG. 6B.

In FIGS. 4, 6A, 6B, 6C, the heat-radiating (hot) heat exchanger 27 is an annular type heat exchanger as shown in FIGS. 4, 6*a*, 6B, 6C, and it comprises a high-temperature side heat exchange housing (annular heat exchange housing) 44 and a heat exchanger body 45 which is coaxially inserted in the high-temperature heat side heat exchange housing 44. Further, a flow passage 46 for heat exchange medium such as cooling water or the like is formed between the high-temperature side heat exchange housing 44 and the heat exchanger body 45, and the upper and lower ends thereof are sealed by seals 47. A refrigerant flow-in port 48 and a refrigerant flow-out port 49 are formed so as to intercommunicate with the flow passage 46.

A number of heat-radiating fins 50 are formed on the outer peripheral wall of the heat exchanger body 45 so as to face the flow passage 46, and also a number of slender grooves 51 are formed in the axial direction on the inner peripheral surface of the heat exchanger body 45 so as to be spaced at predetermined intervals in the peripheral direction of the heat exchanger body 45. A flow passage for the working gas such as helium or the like is formed between the inner cylinder 31 and the slender grooves 51.

In FIG. 3, the heat rejector 27 is connected to a radiator 53 through a cooling water circulating pipe 52 and a cooling water pump P1 to circulate cooling water. The cooling water which is heated through heat exchange in the heat rejector 27 is cooled by a cooling fan 54 of the radiator 53. The cooling water circulating pipe 52 is connected to a reservoir tank 56 through a reservoir valve 55. An air vent 57 is connected to the radiator 53, and also a drain valve 58 is connected to the radiator 53.

As in the case of the low-temperature side heat exchange housing, the heat exchanger body 45 of the heat rejector 27 is formed of SUS, copper, aluminum or other materials by the lost wax casting method, and the heat-radiating fins 50 formed on the outer peripheral surface of the heat exchanger body 45 and the slender grooves 51 formed on the inner peripheral surface of the heat exchanger body 45 are also formed integrally with the heat exchanger body 45 by the lost wax casting method. Accordingly, the high-temperature side heat exchanger thus manufactured by the lost wax casting method is remarkably excellent in heat-radiation performance because the heat-radiating fins 50 are precisely cast in a minutely-crease form on the outer surface of the heat exchanger body 45, and also the working gas is allowed to uniformly flow between the slender grooves 51 and the inner cylinder 31 without disturbing the flow of the working gas even partially because the slender grooves 51 are also precisely cast in the axial direction of the heat exchanger body 45. Therefore, the overall refrigerating performance of the heat exchanger can be enhanced as a whole.

The heat exchanger body 45 of the high-temperature side heat exchanger may be formed by the lost was casting method as described above, or may be manufactured by normal cast iron. Further, as in the case of the low-temperature side heat exchange housing, the heat exchange efficiency can be enhanced to some extent insofar as at least the slender grooves 51 are formed in the axial direction on the inner surface of the heat exchanger body 45 of the high-temperature side heat exchanger.

In the above embodiment, the slender grooves and the fins are formed integrally with each of the low-temperature side heat exchange housing of the heat absorber and the heat exchanger body of the heat rejector so as to be located on the inner and outer peripheral surfaces of each of the low-temperature side heat exchange housing and the heat exchanger body (lost was casting method). However, the present invention is not limited to this embodiment. For example, the outside fins may be provided separately from the low-temperature heat exchange housing (the heat exchanger body) as described below.

Figure 7A:
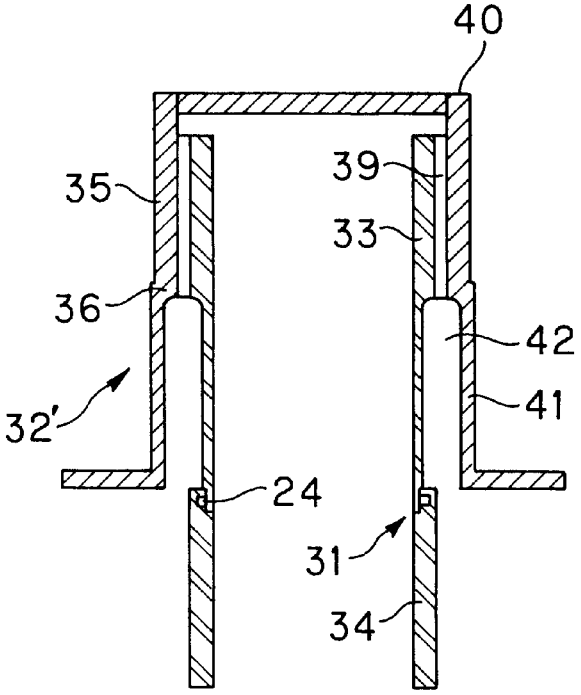
FIG. 7A is a longitudinal-sectional view showing a first modification of the low-temperature side heat exchange housing of the heat exchanger shown in FIG. 4.
Figure 7B:
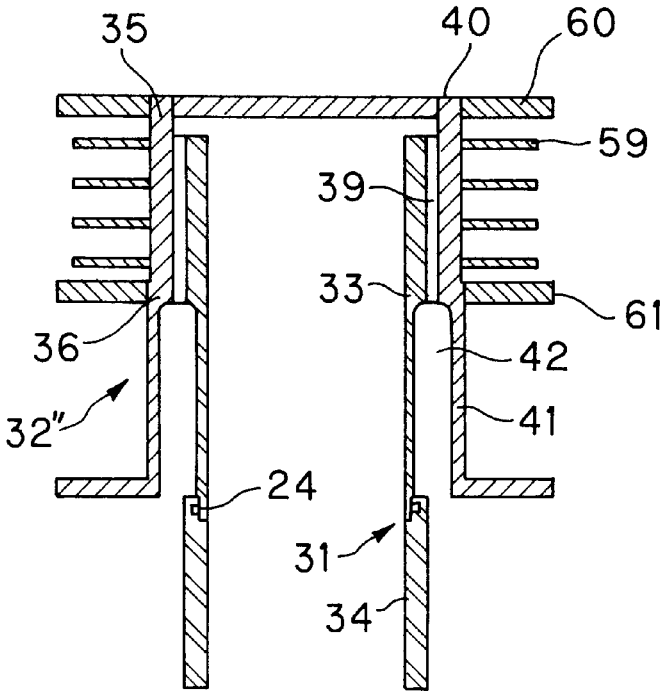
FIG. 7B is a longitudinal-sectional view showing a second modification of the low-temperature side heat exchange housing of the heat exchanger shown in FIG. 4.

FIGS. 7A and 7B are diagrams showing modifications of the low-temperature side heat exchange housing of the expansion cylinder block 20 shown in FIG. 4.

FIG. 7A shows a low-temperature side heat exchange housing 32' according to a first modification. The low-temperature side heat exchange housing 32' of the first modification is not integrally provided with any fin and any flange on the outer peripheral surface thereof by the lost was casting method (however, the slender grooves are formed on the inner peripheral surface). In the first modification, the low-temperature side heat exchange housing is used under the state that no fin and no flange are integrally provided (see FIG. 7A). That is, it is used to perform heat exchange with air or refrigerant which is brought into direct contact with the outer peripheral surface of the low-temperature heat exchange housing, or a heat exchange tube through which refrigerant flows is wound around the outer peripheral surface of the low-temperature heat exchange housing to perform heat exchange with the refrigerant in the heat exchange tube. Besides, outer fins and flanges may be separately formed and then fixed to the outer peripheral surface of the low-temperature heat exchange housing (that is, the outer fins are not formed integrally with the heat exchange housing, but formed separately from the heat exchange housing and afterwards fixed to the heat exchange housing).

FIG. 7B shows a low-temperature side heat exchange housing 32" according to a second modification to which the outer fins and the flanges are fixed after they are formed separately from the heat exchange housing.

In the second modification, outer fins 59 which are formed of Cu, Al, SUS or the like and designed in an annular shape, and flanges 60 and 61 formed of the same material as the heat exchange housing are fixed to the outer peripheral surface of the heat exchange housing by welding or the like. The outer fins may be designed in a spiral form or the like.

FIGS. 8 to 11 show various types of annular plate fins which are separately formed as outer fins and afterwards fixed on the outer peripheral surface of the heat exchange housing in the second modification shown in FIG. 7B. In FIGS. 8 to 11, spacers are interposed between the respective annular plate fins.

Figure 8:
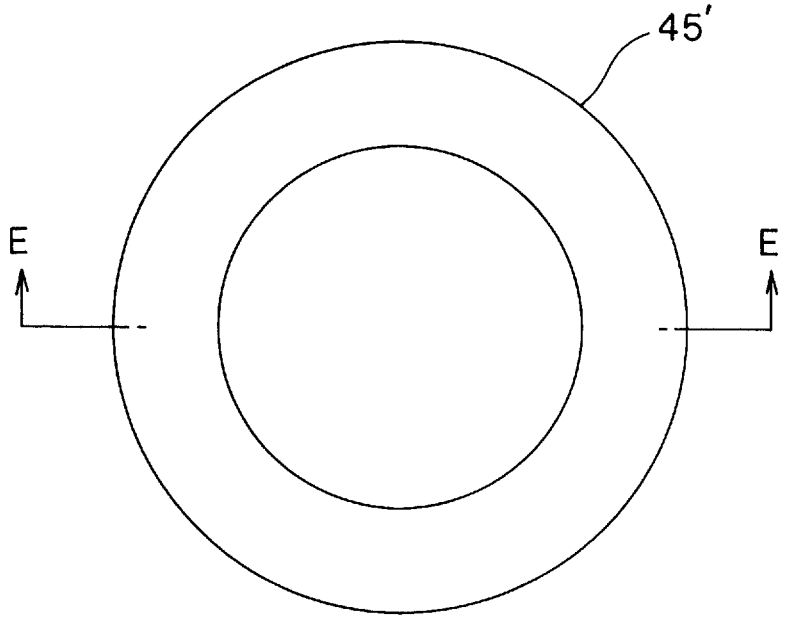
FIG. 8 is a plan view showing an annular plate fin to be fixed on the outer peripheral surface of the heat exchange housing of the heat exchanger according to the present invention.
Figure 9:
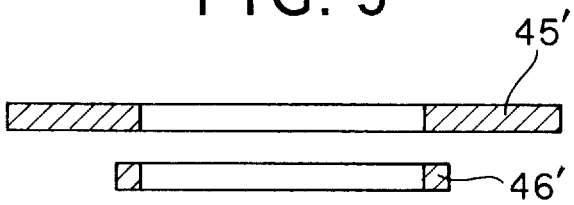
FIG. 9 is a cross-sectional view showing an annular plate fin and a spacer to be fixed on the outer peripheral surface of the heat exchange housing.

FIG. 8 is a plan view showing an annular plate fin 45' and a spacer 46', and FIG. 9 is a cross-sectional view of the annular plate fin 45' and the spacer 46' which is taken along a line E—E of FIG. 8.

The annular plate fin 45' and the spacer 46' are separately manufactured so as to have a sufficient width in the radial direction by a machine working such as a press or cutting work. A plurality of annular plate fins 45' and spacers 46' as described above are joined to the outer peripheral surface of the heat exchanger housing in such a manner as soldering, press-fitting or the like so as to be alternately laminated in the axial direction of the heat exchange housing.

Figure 10:
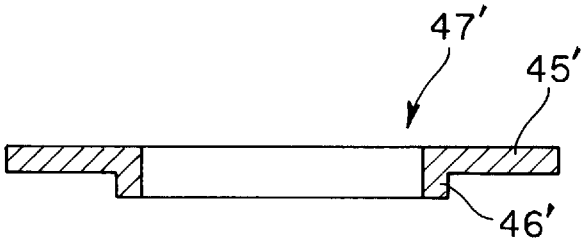
FIG. 10 is a cross-sectional view showing an assembly of an annular plate fin and a spacer to be fixed on the outer peripheral surface of the heat exchange housing.

FIG. 10 shows a spacer-integral type plate fin 47' in which the plate fin 45' and the spacer 46' are integrally formed by a machining work such as a cutting work or the like, and a plurality of spacer-integral type plate fins 47' shown in FIG. 10 are joined to the outer peripheral surface of the heat exchange housing so as to be laminated in the axial direction of the heat exchange housing.

Figure 11:
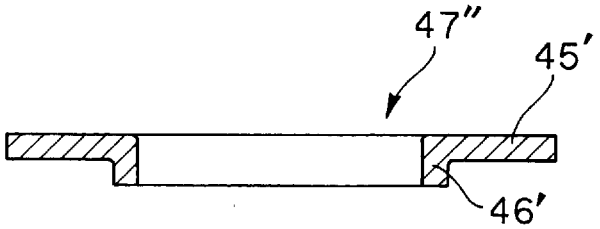
FIG. 11 is a cross-sectional view showing another assembly of an annular plate fin and a spacer to be fixed on the outer peripheral surface of the heat exchange housing.

FIG. 11 shows another spacer-integral type plate fin 47" in which the plate fin 45' and the spacer 46' are integrally formed by press working, and as in the case of the spacer-integral type plate fin 47', a plurality of spacer-integral type plate fins 47" shown in FIG. 11 are joined to the outer peripheral surface of the heat exchange housing so as to be laminated in the axial direction of the heat exchange housing.

In the above embodiments, the plate fins and the spacers are alternately laminated, however, only the annular plate fins may be arranged at predetermined intervals through no spacer on the outer peripheral surface of the heat exchange housing as shown in FIG. 7B.

The first and second modifications may be applied to the low-temperature side heat exchange housing, however, the same construction may be applied to the high-temperature side heat exchange housing.

In the above embodiments and modifications, the heat exchange efficiency can be enhanced to some degree by forming the fin structure (slender groove structure) on at least the inner surface of at least one of the high-temperature side heat exchanger and the low-temperature side heat exchanger. It is needless to say that the heat exchange efficiency can be enhanced more and more by forming the fin structure on the outer peripheral surface of the heat exchanger in addition to the fin structure (slender groove structure) on the inner peripheral surface of the heat exchanger.

Next, the operation of the Stirling refrigerating machine equipped with the heat exchanger as described above will be described with reference to FIG. 3.

The crank shaft 7 is forwardly rotated by the motor 6, and the crank portions 10, 11 in the crank compartment 5 are rotated with keeping a phase shift of 90 degrees. The cross guide heads 9 and 18 are reciprocatively moved through the connection rods 8, 8' which are freely rotatably linked to the crank portions 10, 11. Further, the compression piston 15 and the expansion piston 21 which are linked to the cross guide heads 9, 18 through the compression piston rod 17 and the expansion piston rod 23 respectively are reciprocatively moved with keeping a phase shift of 90 degrees.

The compression piston 15 quickly moves toward the upper dead center in the neighborhood of the midpoint to compress the working gas when the expansion piston 21 slowly moves in the neighborhood of the upper dead center with advancing the movement of the compression piston of the by 90 degrees. The working gas thus compressed passes through the intercommunication hole 30 and the manifold 26 and then flows into the slender grooves 51 of the heat rejector 27. The working gas which is heat-exchanged with the cooling water to radiate heat to the cooling water in the heat rejector 27 is cooled by the regenerator 28, passes through the low-temperature heat exchanger 29 and then flows into the low-temperature chamber 22 (expansion space).

On the other hand, when the compression piston 15 slowly moves in the neighborhood of the upper dead center, the expansion piston 21 quickly downwardly moves toward the bottom dead center and the working gas flowing into the low-temperature chamber 22 (expansion space) is drastically expanded to generate cold heat, whereby the cold head 40 is cooled and kept at a low temperature.

In the cold head 40, the cold-heat refrigerant which is brought into contact with the cooling fins (outer fins) 38 is cooled. When the expansion piston 21 moves from the bottom dead center to the upper dead center, the compression piston 15 moves from the midpoint to the bottom dead center, and the working gas passes from the low-temperature chamber 22 through the slender grooves 39 of the cold head 40 and then flows into the regenerator 28 to stock the cold heat of the working gas in the regenerator 28. The cold heat stocked in the regenerator 28 is reused to cool the working gas fed from the high-temperature chamber 16 through the heat rejector 27 again.

The cold-heat refrigerant cooled in the cold head 40 is used to cool various kinds of cold-heat using equipment. For example, the cold-heat refrigerant is fed to a cold-heat refrigerant pipe in cold-heat using equipment such as a freezer or the like to take a refrigerating or cooling action in the cold-heat using equipment. The cold-heat refrigerant is then circulated and returned to the cold head 40 and cooled again.

The cooling water which is subjected to heat exchange in the heat rejector 27 flows from the cooling water circulating pipe 52 to the radiator, is cooled by the cooling fan and then circulated into the heat rejector 27 again.

In the above embodiment, the 2-piston type Stirling refrigerating machine 1 is used, however, a displacer type Stirling refrigerating machine or other types of Stirling refrigerating machine may be used.

The Stirling machine according to the present invention has the following effects.

(1) By forming the working gas flow passage integrally on the inner peripheral surface of the top heat exchange housing constituting the expansion cylinder block and forming the fins for cooling the cold-heat refrigerant integrally on the outer peripheral of the heat exchange housing in addition to the working gas flow passage, particularly by precisely forming these elements with the lost wax casting method, the workability is enhanced, the structure of the Stirling machine itself can be extremely simplified and the manufacturing cost can be reduced. In addition, the working gas can uniformly flow without being disturbed even partially, and the heat exchange performance and the reliability can be enhanced by the fins which are formed with high precision and uniform in thickness.

(2) Since the annular heat exchange housing and the heat exchanger body of the heat rejector are also integrally formed, particularly by forming these elements with high precision through the lost wax casting process, the workability can be enhanced and the price of the Stirling machine can be reduced. In addition, the working gas is allowed to uniformly flow through the flow passage without disturbing the flow of the working gas even partially, thereby enhancing the heat exchange performance and the reliability.

(3) Refrigerants having low melting point s such as ethyl alcohol, nitrogen, helium, etc. other than flon (fluorocarbons) can be used as the working gas, and thus there can be provided refrigerating machines using flon-alternate refrigerant sources which are more environmentally friendly.

Another embodiment of the heat exchanger according to the present invention will be described with reference to FIGS. 12 to 19.

This embodiment is characterized in that an offset strip fin is provided as a fin structure on at least one of the inner and outer surfaces of a heat exchanger cylinder constituting the heat exchanger body in order to enhance the heat exchange performance more remarkably.

First, the offset strip fin structure will be described with reference to FIGS. 12 and 13.

Figure 12:
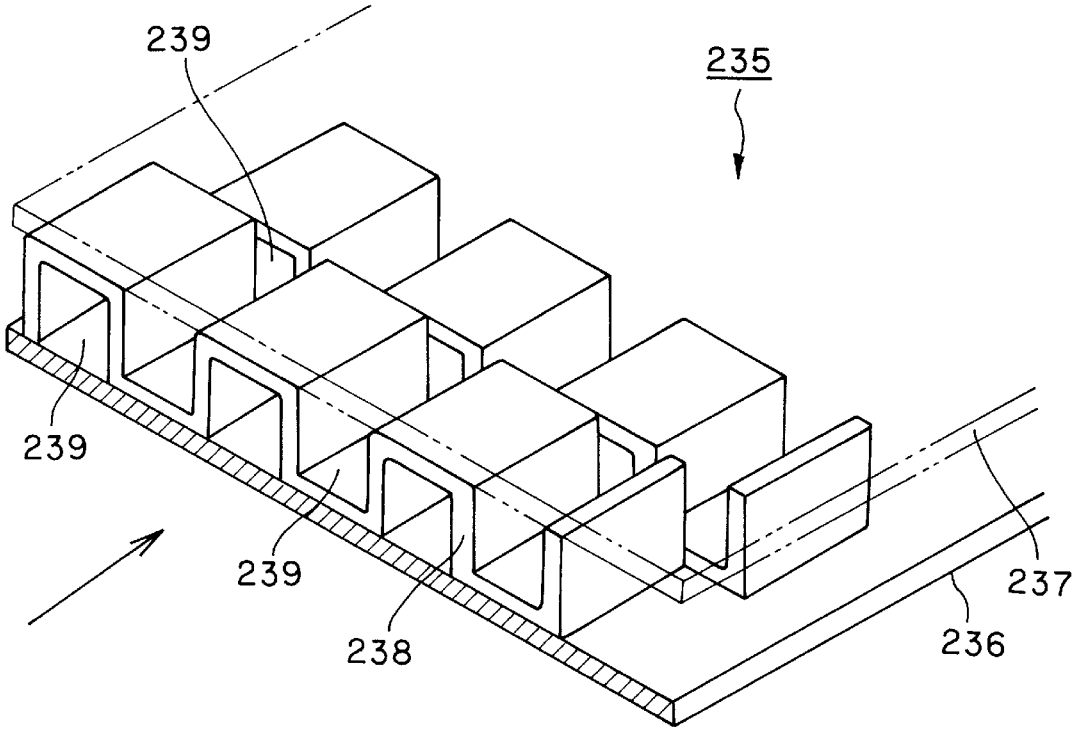
FIG. 12 is a diagram showing an offset strip fin used in the heat exchanger according to the present invention.
Figure 13:
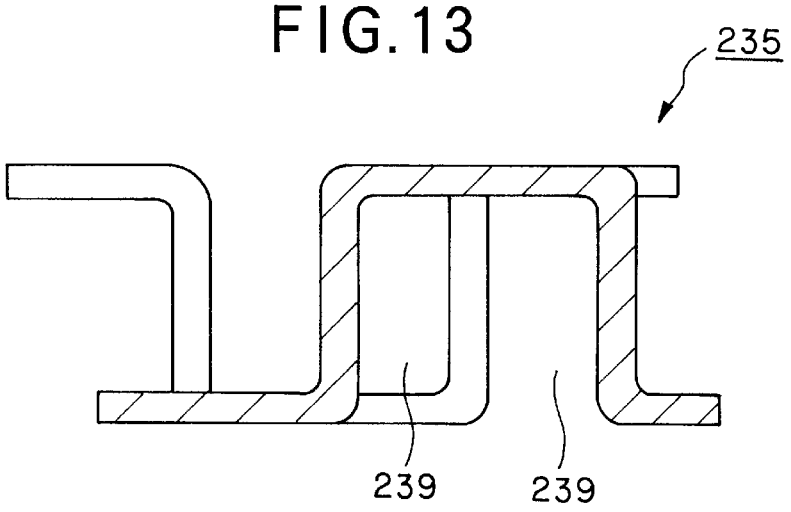
FIG. 13 is an enlarged view showing the main part of the offset strip fin shown in FIG. 12.

FIG. 12 shows a heat exchanger having an offset strip fin 235 interposed between inner and outer support plates 236 and 237, and FIG. 13 is an enlarged view of a part of the offset strip fin 235 shown in FIG. 12.

The offset strip fin 235 is formed as follows. A plurality of elongated band plates 238 having high heat transfer performance are bent so as to be meandered in a zigzag form as shown in FIG. 12, and each of the zigzag-shaped band plates 238 is soldered onto the support plates 236 and 237 so that a plurality of compartment passages 239 of each zigzag-shaped band plate which are rectangular in section are formed in the longitudinal direction of the elongated band plate 238 and also so that the zigzag-shaped band plates 238 are arranged in the direction perpendicular to the longitudinal direction of the bend plates 238 and the compartment passages 239 of the neighboring zigzag-shaped band plates 238 are displaced from each other (i.e., under an offset state) as shown in FIG. 13.

Figure 14:
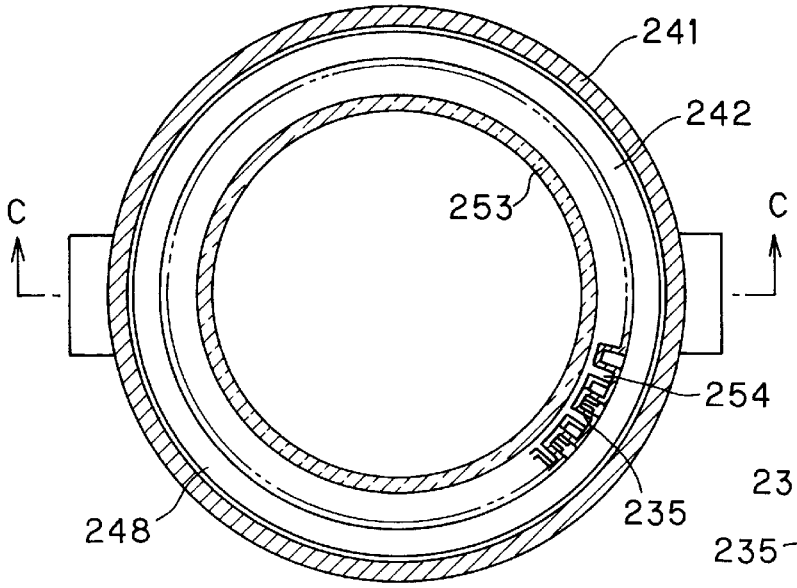
FIG. 14 is a plan view showing a heat exchanger which is provided with the offset strip fin shown in FIG. 12 on the inner surface thereof.
Figure 15:
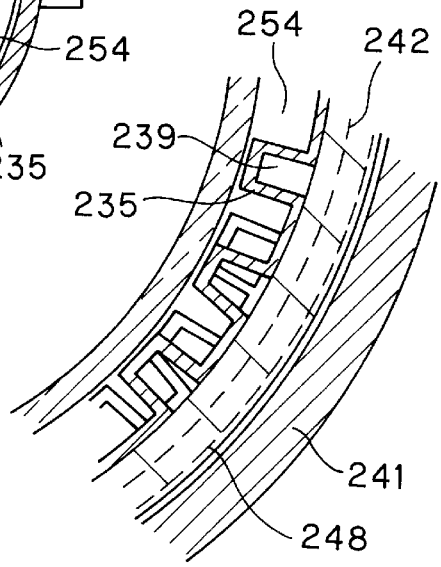
FIG. 15 is an enlarged view of the main part of the heat exchanger shown in FIG. 14.
Figure 16:
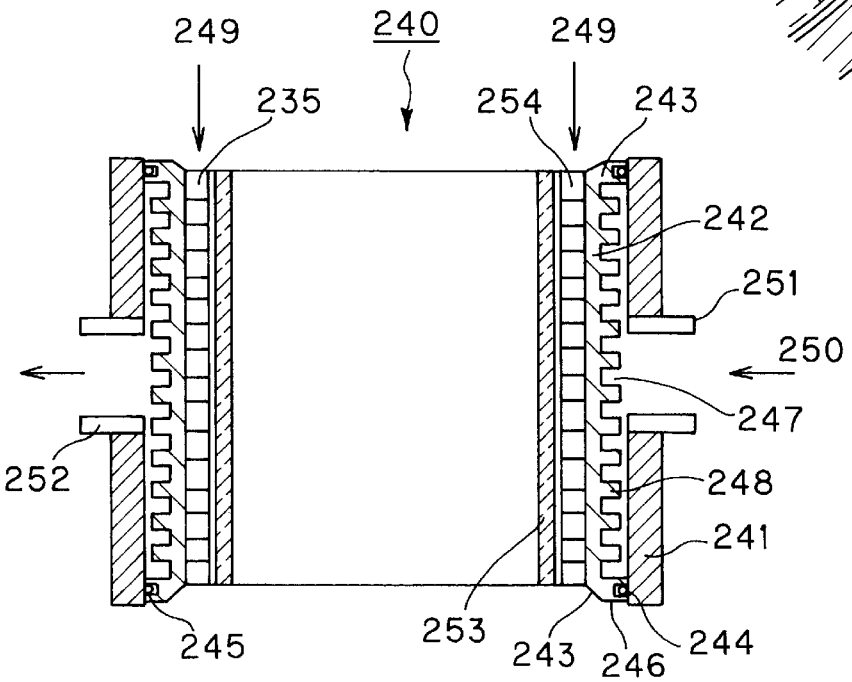
FIG. 16 is a cross-sectional view of the heat exchanger of FIG. 14, which is taken along a line C—C of FIG. 14.

FIGS. 14 to 16 show an embodiment in which the offset strip fin shown in FIGS. 12 and 13 is applied to the heat exchanger for the Stirling machine of the present invention.

In this embodiment, a heat exchanger 240 comprises an outer sleeve 241 and a cylindrical heat exchanger cylinder 242 inserted in the outer sleeve 241, and it is engagedly fixed on the outer periphery of the high-temperature side cylinder and/or the low-temperature side cylinder of the Stirling refrigerating machine shown in FIG. 3 or other types of thermal engines through an inner cylinder (liner) or through no inner cylinder.

The heat exchange cylinder 242 is formed in a cylindrical shape having a proper thickness, and annular sealing potions 243 are formed at the upper and lower end portions thereof. Each of the annular sealing portions 243 comprises a large-diameter potion 244 which is brought into contact with the inner surface of the outer sleeve 241, and a groove 246 in which a seal 245 formed on the outer surface of the large-diameter portion is engagedly fit. The annular space surrounded by the upper sealing potions 243, the outer surface of the heat exchange cylinder 242 and the inner surface of the outer sleeve 241 forms a flow passage 247 through which the heat exchange medium such as cooling water or the like flows. The sealing structure based on the seals 245 may be used as occasion demands.

Further, a plurality of annular heat exchange fins 248 are formed on the outer surface of the heat exchange cylinder 242 so as to project to the flow passage 247 for the heat exchange medium. A flow-in port 251 and a flow-out port 252 for the heat exchange medium are provided at the upper and lower end positions or at the center position of the outer sleeve 241 in the longitudinal direction of the outer sleeve 241 so as to be located at the opposite sides with respect to the axial center of the outer sleeve 241. The heat exchange medium flows from the flow-in port 251 into the flow passage 247 for the heat exchange medium, passes through the flow passage 247 while coming into contact with the heat exchange fins 248 to be heat-exchanged in the heat exchanger 240, and then flows out from the flow-out port 252.

Further, the space defined by the heat exchange cylinder 242 and an inner cylinder or a displacer cylinder 253 disposed inside the heat exchange cylinder 242 forms a working gas flow passage 254 such as helium or the like. The offset strip fin 235 is disposed so as to face the working gas flow passage 254.

Specifically, the offset strip fin 235 is soldered along the inner surface of the heat exchange cylinder 242 so that the longitudinal direction of the elongated band plate 238 is coincident with the peripheral direction of the heat exchange cylinder 242, whereby the offset strip fin 235 is disposed on the inner surface of the heat exchange cylinder 240 so that the arrangement direction of the compartment passages 239 of the offset strip fin 235 is coincident with the longitudinal direction of the heat exchange cylinder 242.

The operation of the heat exchanger 240 according to the above embodiment will be described on the basis of a case where the working gas of the Stirling machine is heat-exchanged with heat exchanging medium such as cooling water or the like to cool the working gas.

The heat exchange medium flows from the flow-in port 251 into the heat-exchange medium flow passage 247 as indicated by an arrow 250, passes through the flow passage 247 and then flows out from the flow-out port 252. When the heat exchange medium flows into the flow passage 247, it is brought into contact with the annular heat exchange fins 248 formed on the outer surface of the heat exchange cylinder 242 to perform heat exchange therebetween.

The working gas flowing into the heat exchanger 240 flows in the axial direction of the heat exchanger 240 along the compartment passages 239 in the working gas flow passage 254 as indicated by an arrow 249. During this time, the working gas is brought into contact with the offset strip fin 235 to perform heat exchange therebetween. In this case, the working gas can be brought into contact with the offset strip fin 35 over a large area, and thus the heat transfer area is large, thereby enhancing the heat exchange performance.

Figure 18:
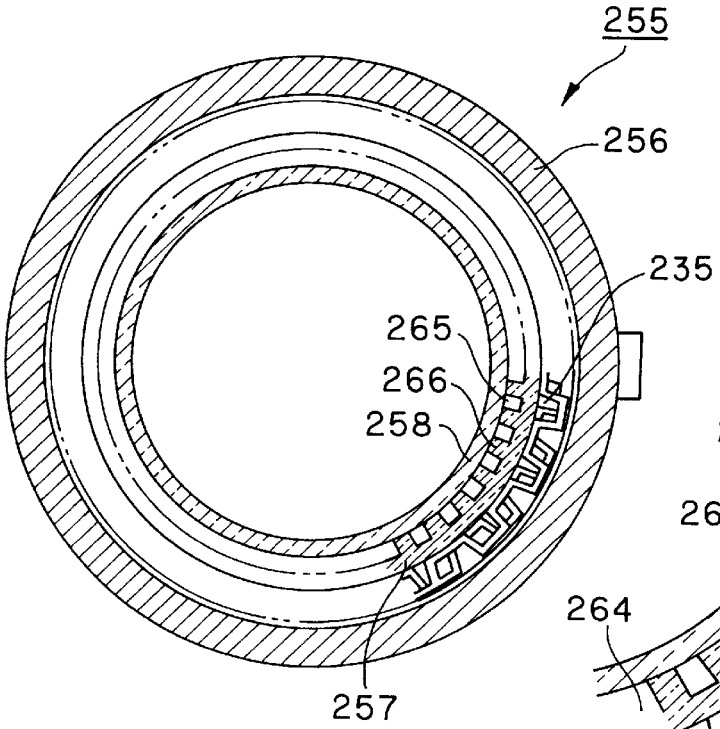
FIG. 18 is a cross-sectional view of the heat exchanger of FIG. 17, which is taken along a line D—D of FIG. 17.
Figure 19:
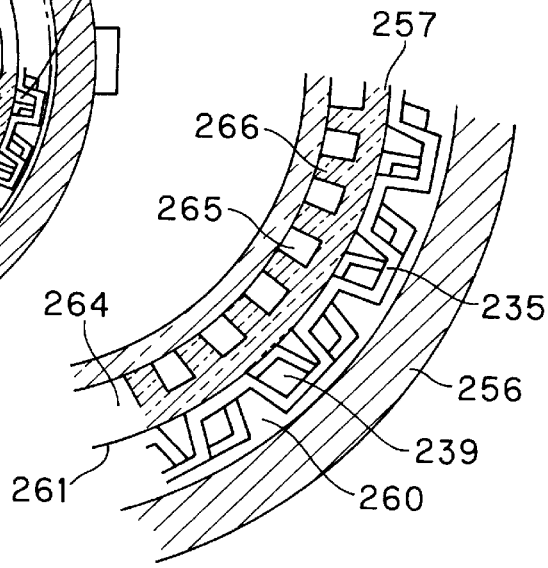
FIG. 19 is an enlarged view of the main part of the heat exchanger shown in FIG. 18.
Figure 17:
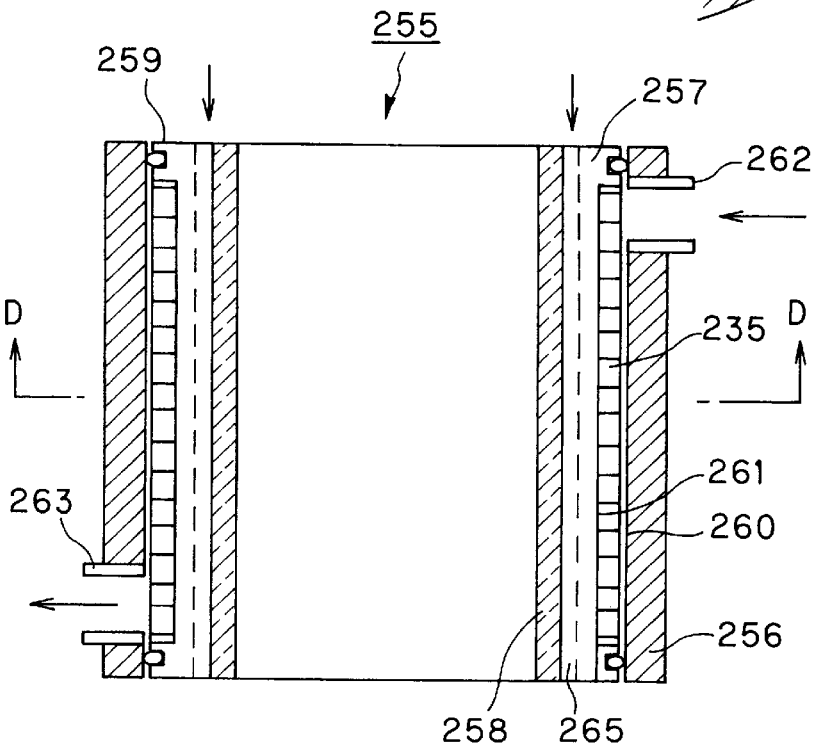
FIG. 17 is a longitudinal-sectional view showing a modification of the heat exchanger shown in FIG. 14.

FIGS. 17 to 19 show a modification of the heat exchange shown in FIGS. 14 to 16. The heat exchanger 255 of this modification has an outer sleeve 256 and a cylindrical heat exchange cylinder 257 inserted in the outer sleeve 256, and it is engagedly fit onto the outer peripheral surface of a cylinder of a thermal engine as shown in FIG. 3.

As in the case of the embodiment shown in FIGS. 14 to 16, the heat exchange cylinder 257 is designed in a cylindrical shape having a suitable thickness, and annular sealing portions 259 having seals engagedly fit therein which are similar to those of the embodiment of FIGS. 14 to 16 are formed at the upper and lower end potions of the heat exchange cylinder 257. The annular space surrounded by the upper ad lower sealing portions 259, the outer surface of the heat exchange cylinder 257 and the inner surface of the outer sleeve 256 form a flow passage 260 for heat exchange medium through which the heat exchange medium such as cooling water or the like flows.

In this modification, the offset strip fin 235 is disposed on the outer surface of the heat exchange cylinder 257 so as to face the heat-exchange medium flow passage 260 unlike the embodiment shown in FIGS. 14 to 16. That is, the offset strip fin 235 is soldered onto the outer surface of the heat exchange cylinder 257 so that the arrangement direction of the compartment passages 239 is coincident with the axial direction of the heat exchange cylinder 257.

A flow-in port for the heat exchange medium is provided at one end potion in the axial direction of the outer sleeve 256 (at the upper potion in FIG. 17), and a flow-out port 263 for the heat exchange medium at the other end potion in the axial direction of the outer sleeve 256 (at the lower end potion in FIG. 17). The heat exchange medium flows from the flow-in port 262 into the heat exchanger 255, passes through the heat-exchange medium flow passage 260 while being subject to heat exchange, and then flows out from the flow-out port 263.

The space defined by the heat exchange cylinder 257 and the inner cylinder 258 or the displacer cylinder forms a working gas flow passage 264 for the thermal engine such as Stirling machine or the like. Spline-shaped cooling fins are formed on the inner surface of the heat exchange cylinder 257 so as to face the working gas flow passage 264. Specifically, a number of minute grooves 265 are formed on the overall inner surface of the heat exchange cylinder 257 so as to extend in the axial direction of the heat exchange cylinder 257 by wire cut processing to thereby form the spline-shaped cooling fins 266.

Next, the operation of the heat exchanger of the above modification will be described on the basis of a case where the working gas for the Stirling engine or the like is heat-exchanged with heat exchange medium such as cooling water or the like through heat exchange therebetween by the heat exchanger 255.

The heat exchange medium flows from the flow-in port 262 into the heat-exchange medium flow passage 260, passes through the heat-exchange medium flow passage 260 and then flows out from the flow-out pot 263. When the heat exchange medium flows through the heat-exchange medium flow passage 260, it is brought into contact with the offset strip fin 235 formed on the outer surface of the heat exchange cylinder 257 to perform the heat exchange therebetween.

On the other hand, the working gas flows along the axial direction while being brought into contact with the spline-shaped fins 266 in the working gas flow passage 264, thereby performing the heat exchange.

In the embodiment and the modification thereof shown in FIGS. 14 to 19, the offset strip fin is provided on the inner or outer surface of the heat exchange cylinder. However, the heat exchanger may be designed so that the offset strip fin is provided on both the inner and outer surfaces of the heat exchanger, so that the working gas and the heat exchange medium are brought into contact with the corresponding offset strip fins.

In the above embodiment, the annular heat exchanger disposed on the outer periphery of the cylinder of the Stirling engine or the like. However, in place of this annular heat exchanger may be used a cylindrical heat exchanger disposed around a pipe through which the working gas flows like a heat exchanger disclosed in Japanese Laid-open Patent Application No. Hei-9-152210.

The cylindrical heat exchanger as described above is formed as follows. That is, a solid spline shaft is engagedly inserted in the heat exchange cylinder, and the flow passage for the working gas is formed between spline grooves formed on the outer surface of the spline shaft and the heat exchange cylinder, and also the offset strip fins 235 are formed on the outer surface of the heat exchange cylinder.

In the above embodiments, the heat exchanger according to the present invention is applied to the Stirling engine, however, it is needless to say that the heat exchanger of the present invention is applied to other types of thermal engines such as a Vuilleumier cycle machine, a Cooke-Yarbourgh cycle machine, etc.

Further, in the above embodiments, the offset strip fin is fixed onto at least one of the inner and outer surfaces of the heat exchange cylinder to dispose the offset strip fin in at least one of the working gas flow passage and the heat-exchange medium flow passage. Therefore, the manufacturing of the heat exchange can be simplified, and the manufacturing cost can be reduced. In addition, the elongated band plate is designed in a zigzag form to thereby increase the contact area between the working gas and the elongated band plate and/or between the heat exchange medium and the elongated band plate, so that the heat exchange performance of the heat exchanger can be enhanced.

Figure 20:
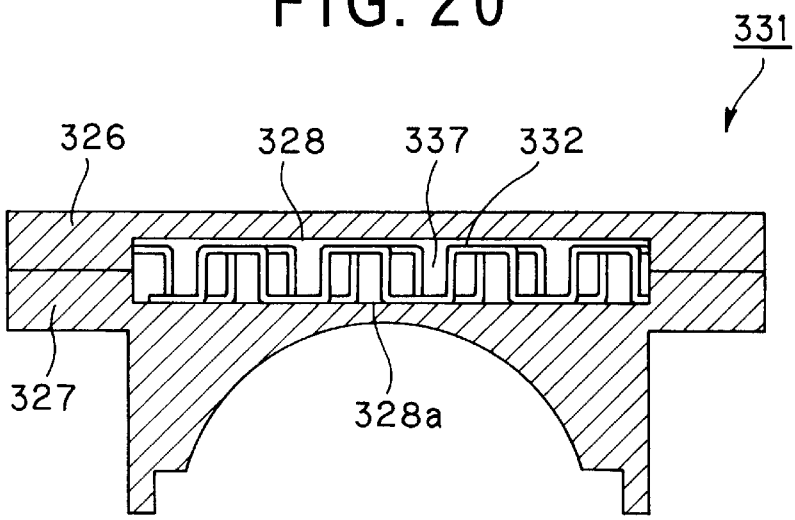
FIG. 20 is a longitudinal-sectional view showing a cold head located at the low-temperature heat exchanger of the present invention, in which an offset strip fin is arranged.
Figure 21:
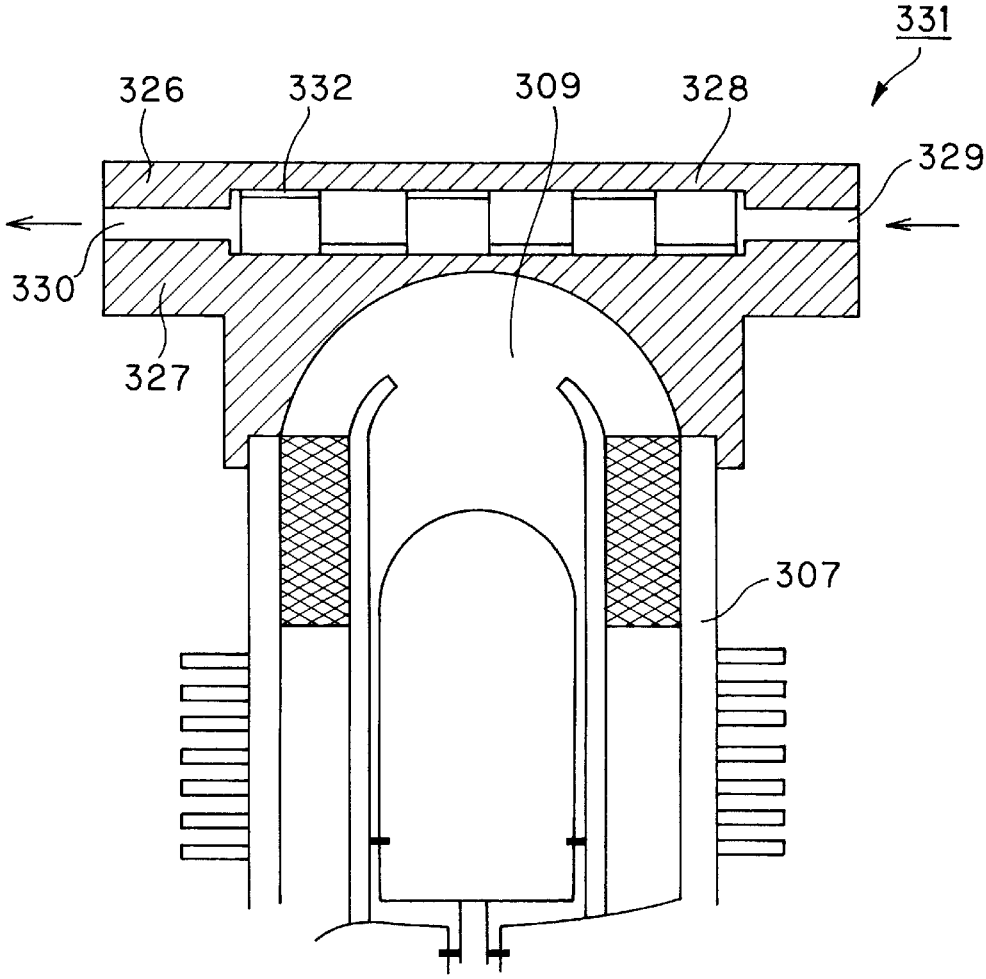
FIG. 21 is an overall diagram showing a state where the cold head of FIG. 20 is fixed to the low-temperature cylinder of the Stirling refrigerating machine.

FIGS. 20 and 21 show an embodiment in which the offset strip fin structure as described above is applied to a cold head of a Stirling refrigerating machine.

In FIGS. 20 and 21, reference numeral 331 represents a cold head provided to the expansion chamber (low-temperature chamber) 309, and an offset strip fin 332 is disposed in a heat-exchange medium flow passage 328.

The structure of the heat exchanger (cold head) having the offset strip fin 332 disposed therein will be described below. The structure of the offset strip fin 332 is the same as shown in FIGS. 12 and 13, and thus the duplicative description thereof is omitted from the following description.

In the cold head 331 having the offset strip fin 332 disposed in the heat-exchange medium flow passage, the offset strip fin 332 is soldered onto the bottom surface 328*a* so that the arrangement direction of the compartment passages 337 of the offset strip fin 332 is coincident with the extending direction of the heat-exchange medium flow passage 328. The heat exchange medium flows from the flow-in pot 319 into the heat-exchange medium flow passage 328, passes through the heat-exchange medium flow passage 328 while brought into contact with the offset strip fin 332, and then flows out from the flow-out port 329. When the heat exchange medium flows through the heat-exchange medium flow passage 328, it is brought into contact with the offset strip fin 332 over a large area, so that the heat exchange performance can be enhanced and the refrigeration power of the refrigerating machine can be enhanced.

If the heat-exchange medium flow passage is designed so as to penetrate in a curved shape along the dome-shaped top surface of the top potion of the expansion space 309 and so that the thickness of the bottom wall thereof is substantially uniform and also the offset strip fin is disposed along the heat-exchange medium flow passage, the heat exchange efficiency can be further enhanced.

In the above embodiment, the heat exchanger of the present invention is applied to the cold head of the Stirling refrigerating machine. However, it is needless to say that the heat exchanger of the present invention is applied to heat-producing cylinders of other types of thermal engines such as a Vuilleumier cycle machine, a Cooke-Yarbourgh cycle machine, etc.

According to the heat exchanger of the above embodiment, the heat-exchange medium flow passage is formed so as to penetrate through the head (cold head) of the cylinder, and thus the heat exchange medium flowing in the heat-exchange medium flow passage is brought into contact with all the surfaces defying the flow passage. Therefore, the contact area is increased and the heat exchange can be further enhanced. Further, if the flow rate of the heat exchange medium is increased by designing the flow passage in a suitable shape, the heat exchange efficiency can be enhanced more and more.

Further, since the offset strip fin is disposed along the heat-exchange medium flow passage, the heat exchange medium is brought into contact with the offset strip fin when it flows through the flow passage, so that the heat exchange performance can be enhanced and the power of the thermal engine, for example, the refrigerating power of the refrigerating machine can be enhanced. In addition, the heat exchanger having high heat exchange performance can be achieved at low cost by a relatively simple manufacturing process of soldering and fixing the offset strip fin in the heat exchange medium flow passage.

Still further, if the heat-exchange medium flow passage is designed so as to penetrate through the cold head along the dome-shaped top surface of the top potion of the expansion space and have the bottom wall which is substantially uniform in thickness, the heat exchange can be highly efficiently performed along the flow passage.

Next, a Stirling cooling system in which a Stirling refrigerating machine using the heat exchanger of the present invention is used in combination with cold-heat using equipment will be described.

Figure 22:
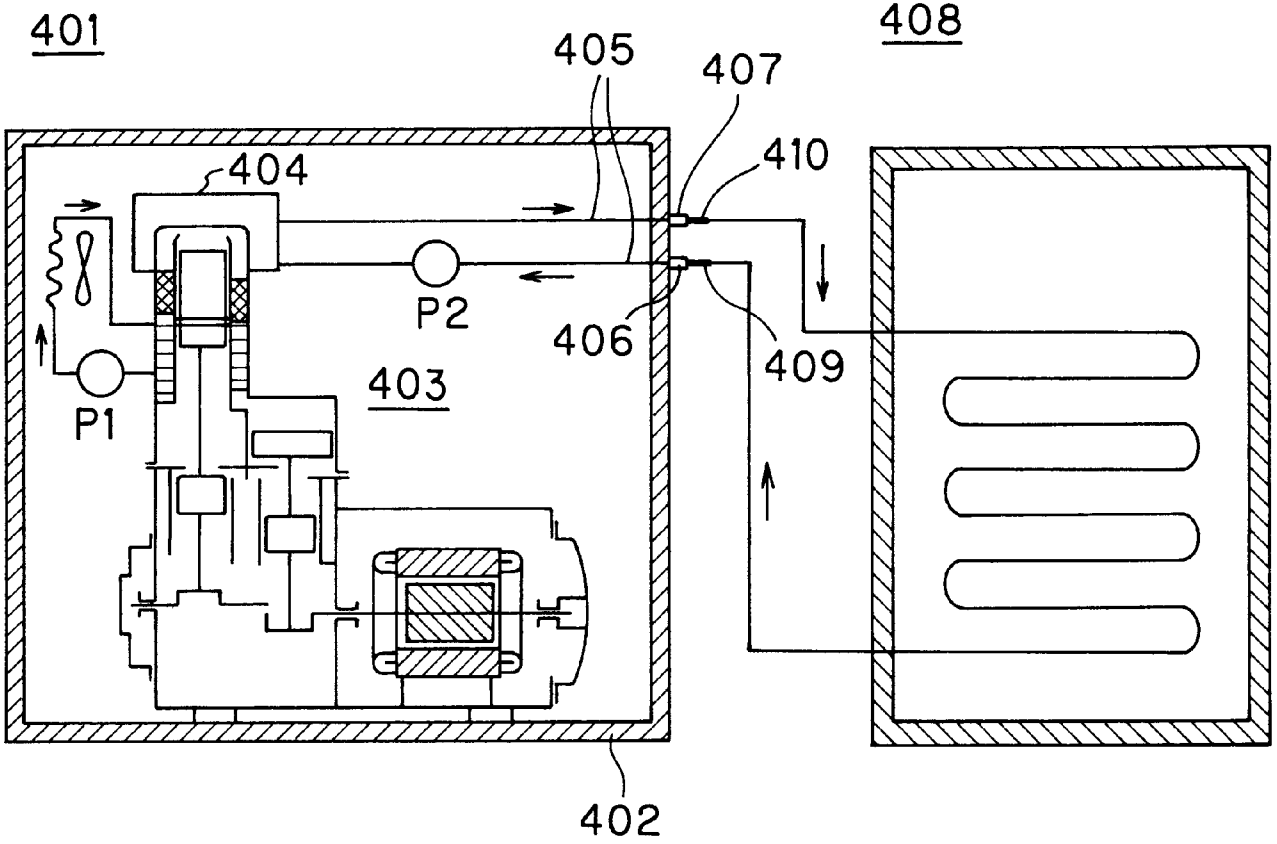
FIG. 22 is an overall diagram showing a Stirling cooling system with the heat exchanger according to the present invention.

FIG. 22 is a diagram showing a Stirling cooling machine according to the present invention.

A stirling cooling machine 401 of the present invention includes a box-shaped case 402, and a Stirling refrigerating machine 403 is disposed in the case 402.

The Stirling refrigerating machine 403 has a cold head 404 as described above. The cold head 404 is connected to a cold-heat refrigerant pipe 405 for circulating cold-heat refrigerant (heat exchange medium (secondary refrigerant) with which cold-heat generated by the low-temperature heat exchanger is carried and fed to cold-heat using equipment such as a refrigerator or the like. Both the ends of the cold-heat refrigerant pipe 405 penetrates through the case 402, and an inlet cock 406 and an outlet cock 407 for the cold-heat refrigerant are provided to the ends of the cold-heat refrigerant pipe 405 at the outside of the case 402.

When the Stirling cooling machine as described above is used, the outlet end 409 and the inlet end 410 of a cold-heat refrigerant pipe of the cold-heat using equipment 408 such as a refrigerator or the like are freely detachably connected to the inlet cock 406 and the outlet cock 407. A cold-heat refrigerant pump P2 is disposed at some midpoint of the cold-heat refrigerant pipe 405 to circulate the cold-heat refrigerant between the cold head 404 of the Stirling refrigerating machine 403 and the cold-heat using equipment 408.

As the cold-heat using equipment 408 may be used a freezer, a refrigerator, an immerse-type cooler, a constant-temperature liquid circulator, a low-temperature thermostat for various temperature characteristic testing, a constant-temperature bath (thermostat), a heat shock testing apparatus, a freeze dryer, a cold cooler and other types of cold-heat using equipment. The Stirling cooling machine 401 of the present invention is usable by connecting the above cold-heat using equipment to the inlet cock 406 and the outlet cock 407.

Next, the Stirling cooling machine 401 of the present invention will be described in detail with reference to FIG. 23. The housing 411 of the Stirling refrigerating machine 403 is formed by casting, and a cylinder 412 is formed at the top portion of the housing 411.

As described above, the inside of the housing 411 is partitioned into the motor compartment 414 and the crank compartment 415 by the compartment wall 413, and the motor which can rotate forwardly and reversely is disposed in the motor compartment 414 while the motion converting mechanism portion 417 for converting the rotational motion to the reciprocating motion is disposed in the crank compartment 415. The opening 418 of the motor compartment 414 and the opening portion 419 of the crank compartment 415 are closed by lids 420 and 421 respectively, thereby keeping the inside of the housing 411 semi-closed.

The crank shaft penetrates through the compartment wall 413 and is rotatably supported by bearing portions 422 of the housing 411, the compartment wall 413 and the lids 420, 421. The motor 416 comprises a stator 424*a* and a rotor 424*b* which is rotatably disposed at the inner peripheral side of the stator, and the crank shaft 423 is fixed to the center of the rotor 424*b*.

The motion converting mechanism portion 417 comprises the crank portion 425 of the crank shaft 423 extending into the crank compartment 145, the connection rods 426, 427 linked to the crank portion 425 and the cross guide heads 428, 429 secured to the tips of the connection rods 426, 427, and it functions as driving means for the Stirling refrigerating machine 403.

The cross guide heads 428, 429 are disposed so as to be reciprocatively movable in cross guide liners 430, 431 provided on the inner wall of the cylinder 412 of the housing 411. The crank portion is designed with keeping a phase shift between the cranks 425*a* and 425*b* so that the crank 425*b* moves prior to the crank 425*a* when the motor 416 is forwardly rotated. The phase shift is generally set to 90 degrees.

A compression cylinder 432 and an expansion cylinder 433 are disposed at the upper portion of the crank compartment 415 of the housing 411 of the Stirling refrigerating machine 403 so that the expansion cylinder 433 is located at a position which is slightly higher than the compression cylinder 432. Working gas such as helium, hydrogen, nitrogen or the like is hermetically filled in the housing containing the compression cylinder 432 and the expansion cylinder 433. The compression cylinder 432 has a compression cylinder block 434 which is fixed to the housing 411 by bolts or the like, and a compression piston 436 provided with a piston ring 435 is reciprocatively slid in the space of the compression cylinder block 434. The upper portion of this space (compression space) serves as a high-temperature chamber 437 and the working gas in the high-temperature chamber 437 is compressed and kept to high temperature.

An compression piston rod 438 is fixed to the compression piston 436 at one end thereof. The compression piston rod 438 is extended through an oil seal 439 at the other end thereof and freely rotatably linked to the cross guide head by a pin. The reciprocating compression piston 436 inverses the sliding direction at both the top and bottom dead centers thereof, and thus the moving speed thereof is equal to zero there. Accordingly, the compression piston 436 moves slowly in the neighborhood of the top and bottom dead centers, and the volume variation per unit time is small. On the other hand, when it moves from the bottom dead center to the top dead center and from the top dead center to the bottom dead center, it moves at the maximum speed at the midpoints of the above movements, and the volume variation per unit time due to the movement of the piston is also maximum.

The expansion cylinder 433 has an expansion cylinder block 440 fixed to the upper portion of the compression cylinder 432 by bolts or the like, and an expansion piston 442 provided with a piston ring 435' is reciprocatively slid in the space of the expansion cylinder block 440. The upper portion of this space serves as a low-temperature chamber 441, and the working gas in the low-temperature chamber 441 is expanded and kept to low temperature. An expansion piston rod 443 is fixed to the expansion piston 442 at one end thereof, and it is extended through an oil seal and linked to the cross guide head 429 at the other end thereof. The expansion piston 442 moves prior to the compression piston 436 by a phase shift of 90 degrees.

Figure 23:
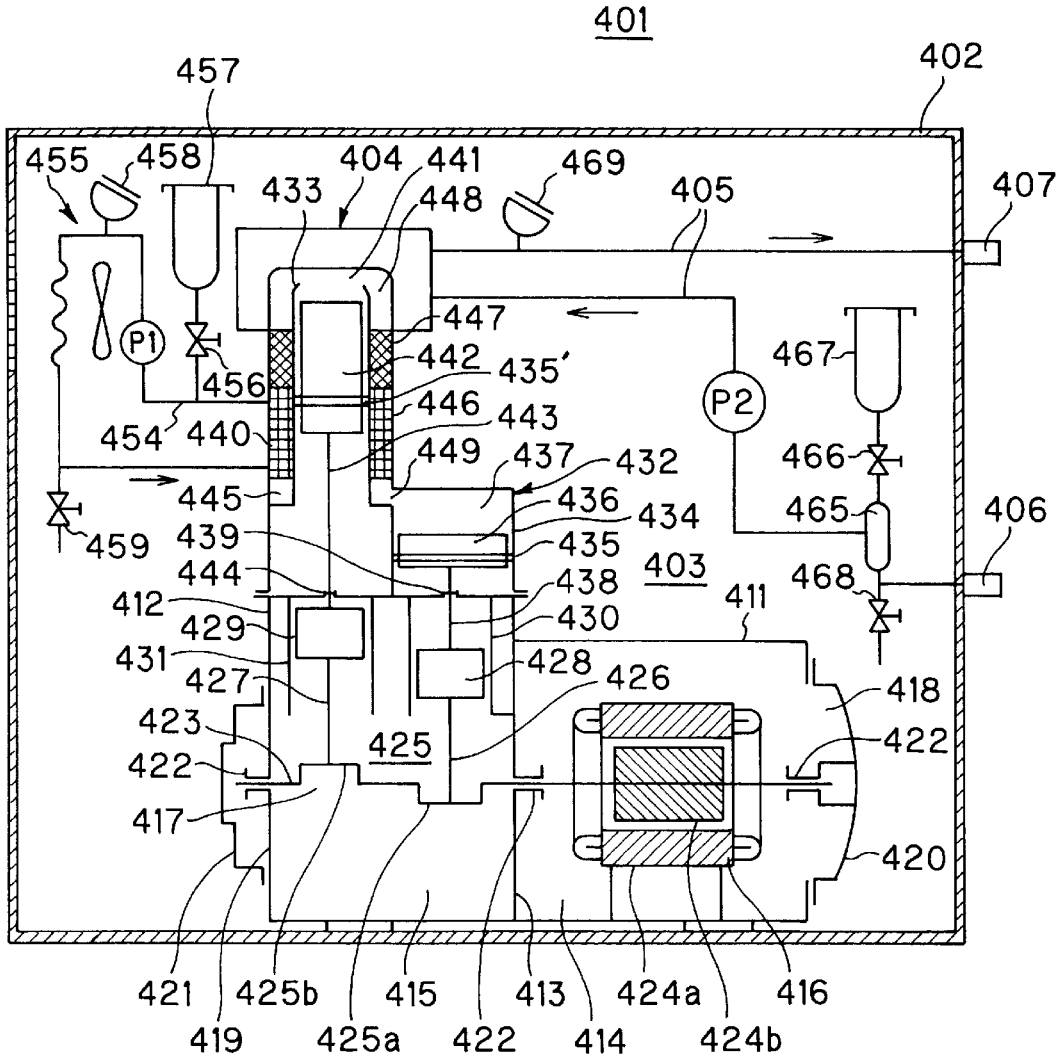
FIG. 23 is a diagram showing a Stirling cooling machine used in the system of FIG. 22.

A manifold 445 through which the working gas flows into/out of the compression space of the compression cylinder 432 is provided to the expansion cylinder block 440 so as to intercommunicate with the expansion cylinder block 440 from the lower side of FIG. 23, and a heat rejector 446, a regenerator 447 and a passage 448 to the low-temperature chamber 441 are annularly provided so as to intercommunicate with one another in this order. An intercommunication hole 449 through which the high-temperature chamber 437 and the manifold 445 intercommunicate with each other is formed in the neighborhood of the upper end of the compression cylinder block 434, whereby the high-temperature chamber 437 (compression space) and the low-temperature chamber 441 (expansion space) are allowed to intercommunicate with each other through the intercommunication hole 449, the manifold 445, the heat rejector 446, the regenerator 447 and the passage 448 in this order. If a heat exchanger is disposed at the passage 448, it is usable as a cooler.

As the heat rejector 446 may be used such a heat exchanger as shown in FIGS. 4 to 11 and FIGS. 14 to 19, or a heat exchanger in which an annular jacket is disposed around an annular working gas flow passage and the working gas is cooled by making cooling water flow into the jacket.

The heat rejector 446 is connected to a radiator 455 through a cooling water circulating pipe 454 and a cooling water pump P1 to circulate the cooling water. The cooling water heat-exchanged by the heat rejector 446 is cooled by a cooling fan of the radiator. A pipe is multipoint-connected to the cooling water circulating pipe 454, and this pipe is connected to a water reservoir tank 457 through a reservoir valve 456. An air vent is connected to the radiator, and also a drain valve 459 is connected to the radiator.

In place of the above water cooling type, the heat rejector 446 may be designed as an air cooling type in which air cooling fins are formed on the outer wall surface of the working gas flow passage 460 of the expansion cylinder block 440.

A cold head 404 is formed at the upper portion of the expansion cylinder block 440. The cold head 404 may be designed so that the offset strip fin as shown in FIGS. 20 and 21 is disposed therein to enhance the heat exchange power.

As described above, the cold head 404 is connected to the cold-heat using equipment 408 through the cold-heat refrigerant pipe 405 and the pump P2 for the cold-heat refrigerant to circulate the cold-heat refrigerant. A suction tank 465 is disposed in the cold-heat refrigerant pipe 405. Further, a cold-heat refrigerant reservoir tank 467 is connected through a reservoir valve 466 to the suction tank 465, and a drain valve 468 is connected to the suction tank 465. An air vent 469 is connected to the cold-heat refrigerant pipe 405.

According to the Stirling cooling machine 401 of the present invention, the Stirling refrigerating machine 403 is designed in a 2-piston structure having the compression cylinder 432 and the expansion cylinder 43 to increase the volume variation of the space filled with the working gas in the Stirling refrigerating machine 403, whereby the Stirling refrigerating machine 403 can be provided with large refrigerating power.

If the Stirling cooling machine 401 of the present invention is provided with a temperature controller, the temperature control of the cold-heat using equipment 408 can be performed at the side of the Stirling cooling machine 401 by merely installing a temperature sensor in the cold-heat using equipment 408.

Figure 24:
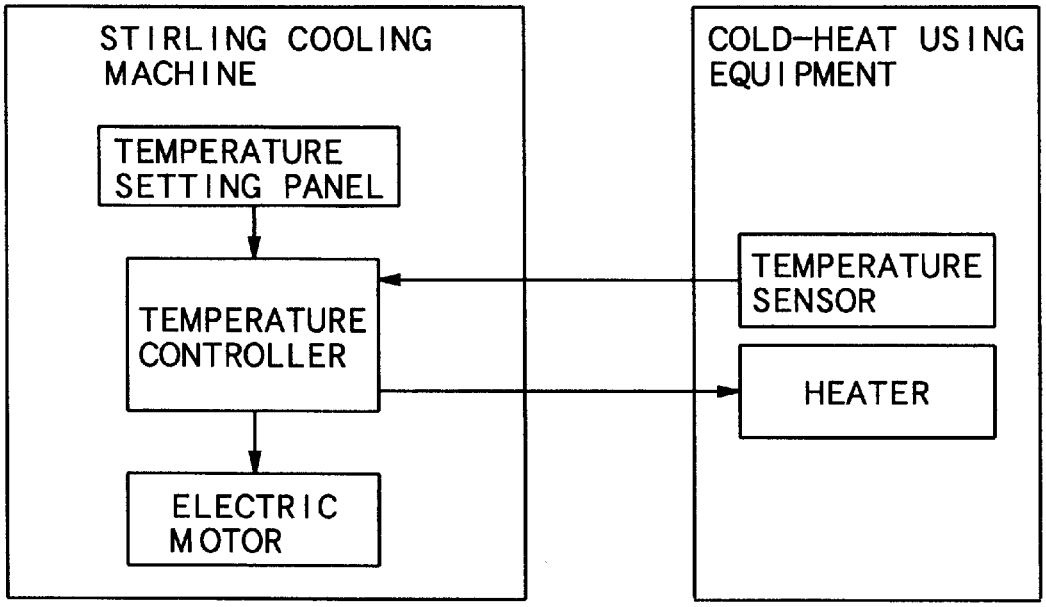
FIG. 24 is a block diagram showing a temperature controller for cold-heat using equipment of the Stirling cooling system shown in FIG. 22.

That is, as shown in FIG. 24, a temperature sensor is disposed in the cold-heat using equipment 408, and a temperature controller which can perform temperature setting with a temperature setting panel is disposed in the Stirling cooling machine. The temperature controller has a temperature control circuit with a comparison circuit, and a temperature signal for the cold-heat using equipment 408 which is detected by the temperature sensor is compared with a set temperature in the comparison circuit to judge whether the detected temperature is within a permissible temperature range containing the set temperature at the center thereof. The motor 416 of the Stirling refrigerating machine 403 is subjected to On/Off control or inverter control on the basis of the judgment result to adjust the refrigerating power of the Stirling refrigerating machine (adjust the temperature of the cold-heat refrigerant), whereby the cold-heat using equipment can be operated with keeping the temperature of the cold-heat using equipment within the permissible temperature range.

When the Stirling cooling machine 401 of the present invention is applied to cold-heat using equipment 408 having an electric heater, in addition to the control temperature based on the driving control of the motor 416 of the Stirling refrigerating machine 403 as described above, the temperature signal from the temperature sensor and the set temperature is compared with each other by the controller, and the heater is subjected to PID (Proportional plus Integral plus Derivative) control on the basis of the difference between the temperature signal and the set temperature, whereby the temperature control is more precisely performed on the cold-heat using equipment.

Next, the operation of the Stirling cooling machine 401 of the above embodiment will be described.

The crank shaft 423 is forwardly rotated by the motor 416, and the cranks 425*a* and 425*b* in the crank compartment 415 are rotated with keeping a phase shift of 90 degrees therebetween. The cross guide heads 428, 429 secured to the tip portions of the connection rods 426, 427 which are freely rotatably linked to the crank portions 425*a*, 425*b* are reciprocatively slid in the cross guide liners 430, 431. The compression piston 436 and the expansion piston 443 which are linked to the cross guide heads 428 and 429 through the compression piston rod 438 and the expansion piston rod 443 respectively are reciprocatively moved with keeping a phase shift of 90 degrees therebetween.

When the expansion piston 442 moves slowly in the neighborhood of the top dead center prior to the compression piston 436 by 90 degrees, the compression piston 436 quickly moves toward the top dead center in the neighborhood of the midpoint to perform the compression operation of the working gas. The working gas thus compressed is passed through the intercommunication hole 449 and the manifold 445 and flows into the heat rejector 446. The working gas which transfers heat to the cooling water in the heat rejector 446 is cooled by the regenerator 447, passed through the passage 448 and then flows into the low-temperature chamber 441 (expansion space).

When the compression piston moves slowly in the neighborhood of the top dead center, the expansion piston 442 quickly moves toward the bottom dead center, and the working gas flowing in the low-temperature chamber 441 (expansion space) is rapidly expanded to produce cold heat, whereby the top portion of the expansion cylinder block 440 of the cold head 404 surrounding the expansion space is cooled and kept to a low temperature.

In the cold head 404, the cold-heat refrigerant circulating in the cold-heat refrigerant pipe is cooled. When the expansion piston 442 moves from the bottom dead center to the top dead center, the compression piston 436 moves from the midpoint to the bottom dead center, and the working gas passes from the expansion space through the passage and flows into the regenerator to reserve the cold heat of the working gas in the regenerator 447. The cold-heat reserved in the regenerator 447 is reused to cool the working gas fed from the high-temperature chamber 437 through the heat rejector 446 again.

The cold-heat refrigerant cooled in the cold head 404 is fed from the cold-heat refrigerant pipe 405 through the cold-heat refrigerant outlet cock 407 to the cold-heat refrigerant pipe in the cold-heat using equipment 408 such as a freezer or the like, and it takes a refrigerating or cooling action in the cold-heat using equipment 408. In the cold-heat using equipment 408, the cold-heat absorbs heat to take the cooling action. Thereafter, it is fed from the cold-heat refrigerant pipe to the cold-heat refrigerant inlet cock 406 of the Stirling cooling machine 401, passed through the cold-heat refrigerant pipe 405 and then returned to the cold head 404 to be cooled. As described above, the cold-heat refrigerant is circulated between the cold head 404 of the Stirling refrigerating machine 403 and the cold-heat using equipment 408. The cold-heat refrigerant thus circulated is cooled in the Stirling refrigerating machine 403 and then it takes the cooling action in the cold-heat using equipment 408. This cycle is repeated.

The cooling water heat-exchanged in the heat rejector 446 flows from the cooling water circulating pipe 454 to the radiator 455, is cooled by the cooling fan, and then is circulated to the heat rejector 446 again.

Next, a defrosting operation of defrosting an heat exchanger of the cold-heat using equipment 408, the cold head 404, etc. will be described.

The defrosting operation is performed as follows. Occurrence of frost on the cold head 404, the cold-heat using equipment 408, etc. is detected by a frost detection sensor provided to each of the cold head 404, the cold-heat using equipment, etc., and the motor 416 of the Stirling refrigerating machine 403 is reversely rotated by a control circuit for defrosting. In this case, the compression piston 436 serves as an expansion piston and the expansion piston 442 serves as a compression piston just reversely to the case where the motor 416 is forwardly rotated.

Accordingly, the working gas in the expansion space of the expansion cylinder 433 is compressed by the expansion piston 442 to produce heat, and the cold-heat refrigerant is heated in the cold head 404. The cold-heat refrigerant thus heated is circulated in the cold-heat using equipment 408 to thereby remove the frost occurring in the cold head 404, the heat exchanger of the cold-heat using equipment 408, etc. Accordingly, the defrosting operation can be effectively performed on even cold-heat using equipment having no heater wire on the surface of the heat exchanger. If a heater wire is mounted at a frost-occurring place of the heat absorber of the cold-heat using equipment 408, etc., the defrosting can be more effectively performed by detecting occurrence of frost with the frost sensor.

When the cold-heat using equipment 408 is a cooling thermostatic chamber, the heating operation based on the reverse rotation of the motor 416 can be utilized. That is, the temperature of the thermostatic chamber is measured while a normal cooling operation is carried out on the Stirling cooling machine of the present invention, and the reverse rotation of the motor 416 is controlled every time the temperature measurement by the temperature control circuit of the temperature controller to perform a heating operation, thereby keeping the temperature of the thermostatic chamber constant.

Next, a Stirling cooling/heating system fabricated by combining the Stirling cooling machine shown in FIG. 22 with hot-heat using equipment will be described with reference to FIGS. 25 to 27.

Figure 25:
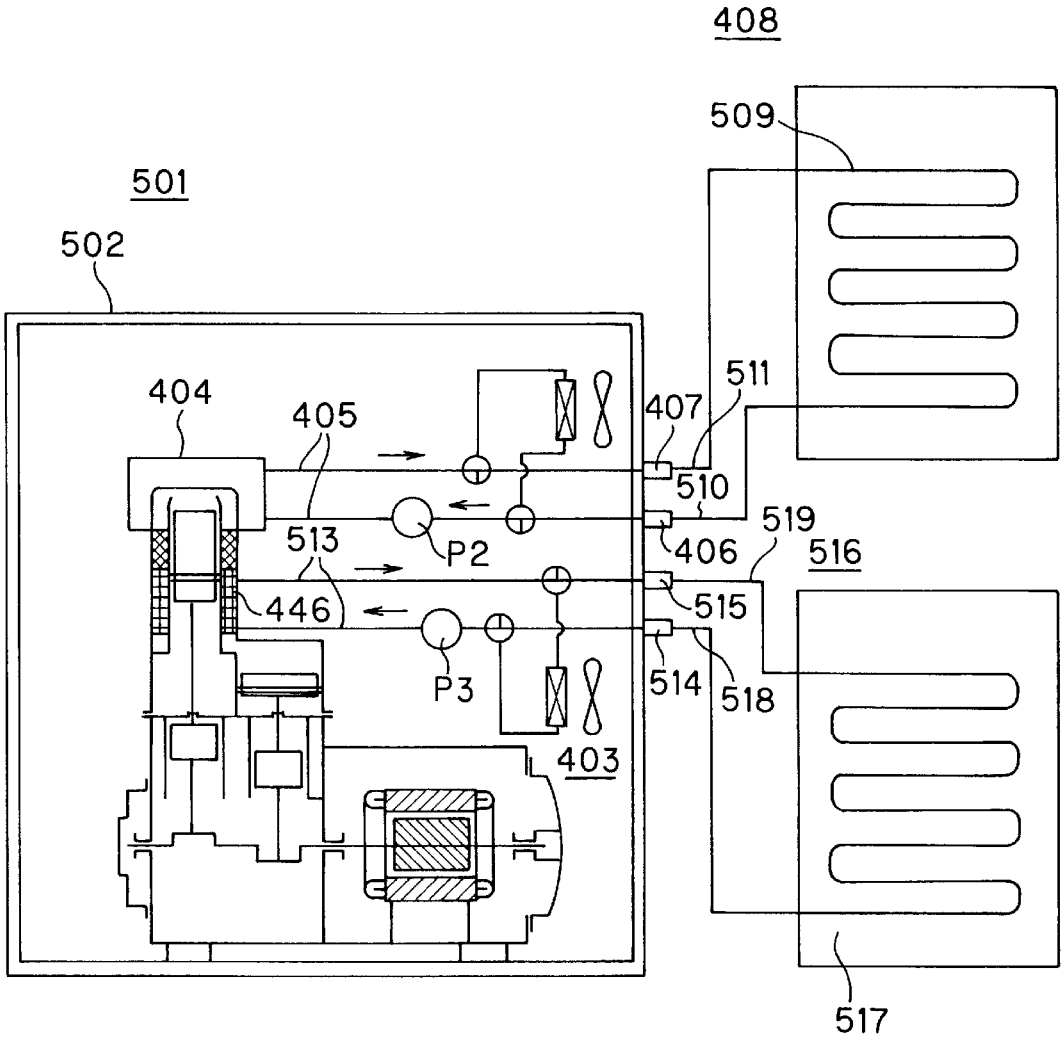
FIG. 25 is an overall diagram showing a Stirling cooling/heating system with the heat exchanger according to the present invention.

FIG. 25 is a diagram showing the Stirling cooling/hating machine which is used in combination with cold-heat using equipment and hot-heat using equipment. The same elements as the embodiment shown in FIGS. 22 to 24 are represented by the same reference numerals. The basic construction and operation of the Stirling cooling/heating machine of this embodiment are the same as the embodiment shown in FIGS. 22 to 24, and the duplicative description thereon is omitted from the following description. Only the difference from the embodiment shown in FIGS. 22 to 24 (i.e., the heat exchange operation with the hot-heat using equipment is also carried out) will be described.

A stirling cooling/heating machine 501 of this embodiment uses not only the heat exchange between the low-temperature side heat exchanger (cold head) of the Stirling cooling machine as described above and the cold-heat refrigerant circulating in the cold-heat using equipment, but also the heat exchange between the high-temperature side heat exchanger (heat rejector) and the hot-heat refrigerant circulated in the hot-heat using equipment.

That is, the heat rejector (high-temperature heat exchanger) 446 of the Stirling refrigerating machine 403 is connected to a hot-heat (heat radiating) refrigerant pipe 513 for circulating hot-heat refrigerant (which is used to feed the heat produced in the Stirling refrigerating machine to the outside, and water or the like is used as the hot-heat refrigerant) and a hot-heat refrigerant pump P3. Both the ends of the hot-heat refrigerant pipe 513 penetrates through a case 502 and is provided with an inlet cock 514 and an outlet cock 515.

When the Stirling cooling/heating machine 501 of the present invention is used, the outlet end 518 and the inlet end 519 of a hot-heat refrigerant pipe 517 of the hot-heat using equipment 516 are freely detachably linked to the inlet cock 514 and the outlet cock 515, whereby a circulation circuit is formed between the hot-heat refrigerant pipe 513 of the heat rejector 446 of the Stirling refrigerating machine 403 and the hot-heat refrigerant pipe 517 of the hot-heat using equipment and the hot-heat using equipment 516 is heated by the Stirling cooling/heating machine 501. As the hot-heat using equipment 516 may be used a thermostatic tank, heating equipment, a heating tester, a hot-water supplier or the like.

As described above, the cold head 404 is connected to the cold-heat using equipment 408 through the cold-heat refrigerant pipe 405 and the cold-heat refrigerant pump P2 to circulate the cold-heat refrigerant. As shown in FIG. 26, the cold-heat refrigerant pipe 405 is further connected through three-way change-over valves 560 as change-over valves to a heat exchanger 562 (heat sink) having a fan 561 which performs heat exchange with the outside. By switching the three-way change-over valves 560, the cold head 404 is connected to the heat exchanger 562 through the cold-heat refrigerant pipe 405 and the three-way change-over valves 560 to thereby forming a cold-heat refrigerant circulating passage.

The heat rejector 446 is connected to the inlet cock 514 and the outlet cock 515 through the hot-heat refrigerant pipe 513 and the hot-heat refrigerant pump P3 to make the hot-heat refrigerant flow therein. The hot-heat refrigerant heated by the heat rejector 512 is connected through the inlet cock 514 and the outlet cock 515 to the hot-heat refrigerant pipe 517 of the hot-heat using equipment 516, thereby forming a hot-heat refrigerant circulating passage.

The hot-heat refrigerant pipe 513 is connected to a radiator 567 having a radiating fan 566 through three-way change-over valves 565 serving as change-over valves. By switching the three-way change-over valves 565, the heat rejector 446 is connected to the radiator 567 through the hot-heat refrigerant pipe 513 and the three-way change-over valves 565, and the hot-heat refrigerant heated by the heat rejector 446 is connected through the hot-heat refrigerant pipe 513 and the three-way change-over valves 565 to the radiator 567, thereby forming a hot-heat refrigerant circulating passage.

If the Stirling cooling/heating machine 501 of this embodiment is provided with a temperature controller for the cold-heat using equipment and the hot-heat using equipment, the same temperature control as the embodiment shown in FIGS. 22 to 24 can be performed on both the cold-heat using equipment 408 and the hot-heat using equipment 516 at the side of the Stirling cooling/heating machine 501 by merely mounting a temperature sensor in each of the cold-heat using equipment 408 and the hot-heat using equipment 516.

Figure 27:
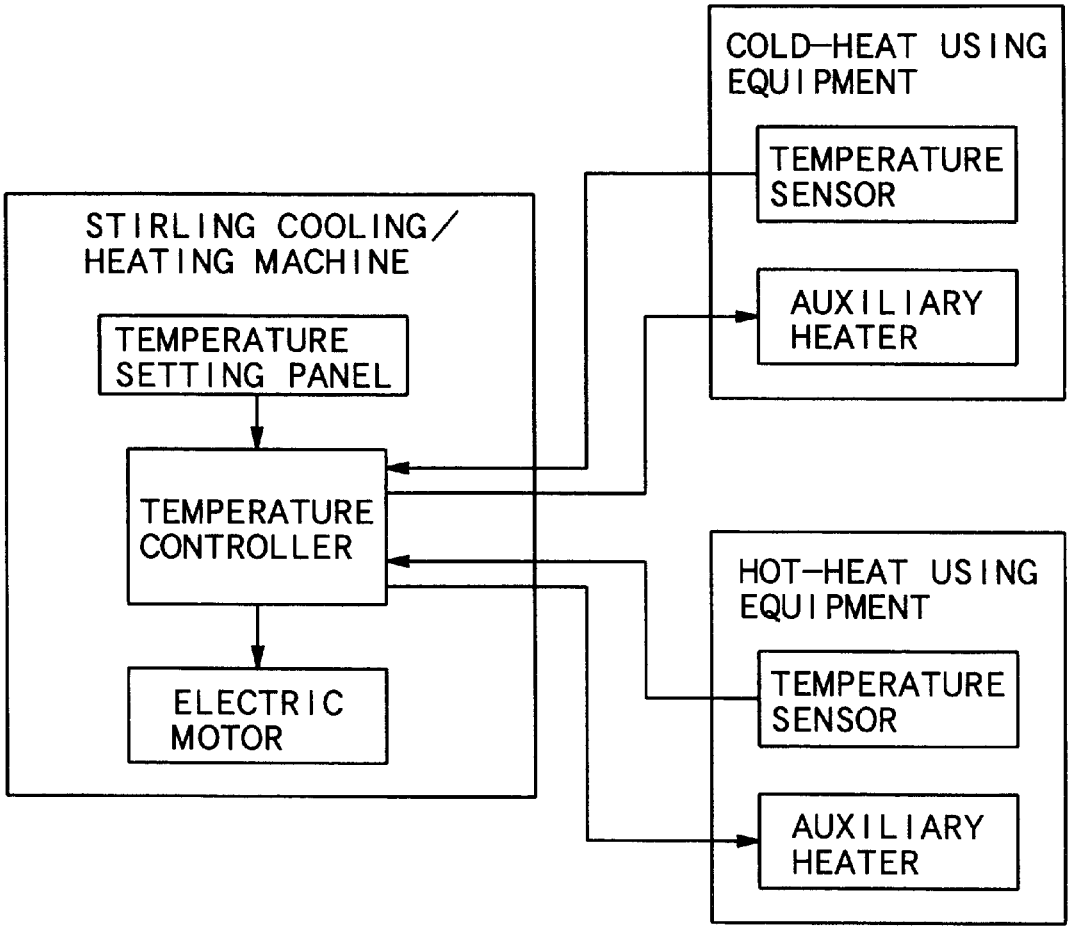
FIG. 27 is a block diagram showing a temperature controller for cold-heat using equipment and hot-heat using equipment of the Stirling cooling/heating system of FIG. 25.

That is, as shown in FIG. 27, a temperature sensor is disposed in each of the cold-heat using equipment 408 and the hot-heat using equipment 516, and a temperature controller which can perform temperature setting with a temperature setting panel is disposed in the Stirling cooling/heating machine. The temperature controller has a comparison circuit, and a temperature signal for each of the cold-heat using equipment 408 and the hot-heat using equipment 516 which is detected by the temperature sensor is compared with a set temperature in the comparison circuit to judge whether the detected temperature is within a permissible temperature range containing the set temperature at the center thereof. The motor 416 of the Stirling refrigerating machine 403 is subjected to On/Off control or inverter control on the basis of the judgment result to adjust the refrigerating power of the Stirling refrigerating machine (adjust the temperature of the cold-heat refrigerant), whereby the cold-heat using equipment and the hot-heat using equipment can be operated with keeping the temperature of the cold-heat using equipment within the permissible temperature range.

Further, by reversely rotating the motor 416, the compression piston 436 and the expansion piston 442 move with keeping the phase shift therebetween, but just reversely to the case where the motor is forwardly rotated. That is, the compression piston 436 serves as an expansion piston to produce cold heat while the expansion piston 442 serves as a compression piston to produce hot heat. Accordingly, if the motor 416 is reversely rotated in accordance with the result of the comparison circuit of the temperature controller, the temperature of the cold-heat using equipment 408 and the hot-heat using equipment 516 can be quickly controlled, and each equipment can be driven with keeping the temperature thereof within the corresponding permissible temperature range.

When the cold-heat using equipment 408 and the hot-heat using equipment 516 are used at the same time, it is estimated that when the temperature control of one equipment is performed, the temperature of the other equipment is out of the permissible temperature range. For example when the temperature of the cold-heat using equipment 408 rises up over the permissible temperature range, the temperature of the cold-heat using equipment 408 can be reduced and returned within the permissible temperature range by increasing the output power of the motor 416. However, the temperature of the hot-heat using equipment 516 temporarily rises up over the permissible temperature range.

In order to avoid such a situation, various countermeasures are taken. For example, the temperature control is more concentratively applied to one of the cold-heat using equipment 408 and the hot-heat using equipment 516. Alternatively, by switching the three-way change-over valves 565 (or 560), the heat rejector (or the cold head) is connected to the radiator (or the heat sink), and the supply of the hot-heat refrigerant (cold-heat refrigerant), that is, the supply of the hot heat (cold heat) to the hot-heat using equipment 516 (or cold-heat using equipment 408) is stopped. Further, auxiliary heating means such as an electric heater or the like is provided to the hot-heat using equipment 516 (or cold-heat using equipment) to perform auxiliary temperature control.

When the Stirling cooling/heating machine 501 of the present invention is applied to the cold-heat using equipment 408 having an electric heater, in addition to the temperature control based on the driving control of the motor 416 of the Stirling refrigerating machine 403 as described above, the temperature signal from the temperature sensor and the set temperature are compared with each other in the controller to perform PID control on the heater on the basis of the comparison result, thereby performing more precise temperature control.

In FIG. 27, the temperature setting panel is provided to the Stirling cooling/heating machine. However, the temperature setting panel may be provided to each of the cold-heat using equipment 408 and the hot-heat using equipment 516 to perform the temperature setting from each using equipment side.

In the above embodiment, the Stirling cooling/heating machine 501 has the case 502. However, when it has no case, the inlet cocks and the outlet cocks for the cold-heat refrigerant and the hot-heat refrigerant, etc. may be suitably secured through a support member to the constituent portion of the Stirling cooling/heat machine such as the Stirling refrigerating machine or the like, thereby uniting these elements with each other.

Next, there will be described the case where the cold-heat using equipment 408 and the hot-heat using equipment 516 are used at the same time in combination with the Stirling cooling/heating machine 501. When the cold-heat using equipment and the hot-heat using equipment are used at the same time, the three-way valve is set as shown in FIGS. 25 and 26.

The cold-heat refrigerant cooled in the cold head 404 is fed from the cold-heat refrigerant pipe 405 through the outlet cock 407 into the cold-heat refrigerant pipe 509 of the cold-heat using equipment 408 such as a refrigerator or the like. The cold heat thus fed takes a cooling action in the cold-heat using equipment 408 to transfer the cold heat to the cold-heat using equipment 408. Thereafter, the cold-heat refrigerant is fed from the cold-heat refrigerant pipe 509 to the inlet cock 406, passed through the cold-heat refrigerant pipe 405 and then returns to the cold head 404 to be cooled. As described above, the cold-heat refrigerant is circulated between the cold head 404 of the Stirling refrigerating machine 403 and the cold-heat using equipment 408. It is cooled in the Stirling refrigerating machine 403, and then takes the cooling action in the cold-heat using equipment 408. The same cycle is subsequently repeated.

On the other hand, the hot-heat refrigerant heated in the heat rejector 446 is fed from the hot-heat refrigerant pipe 513 through the outlet cock 515 into the hot-heat refrigerant pipe 517 of the hot-heat using equipment 516 such as a thermostatic tank or the like, and it takes a heating action in the hot-heat using equipment 516. Thereafter, the hot-heat refrigerant is fed from the hot-heat refrigerant 517 to the inlet cock 514 of the hot-heat refrigerant, passed through the hot-heat refrigerant pipe 513 and returned to the heat rejector 446 to be heated. As described above, the hot-heat refrigerant is circulated between the heat rejector 446 of the Stirling refrigerating machine 403 and the hot-heat using equipment 516, heated in the Stirling refrigerating machine 3 and takes the heating action in the hot-heat using equipment 516. The same cycle is subsequently repeated.

Figure 26:
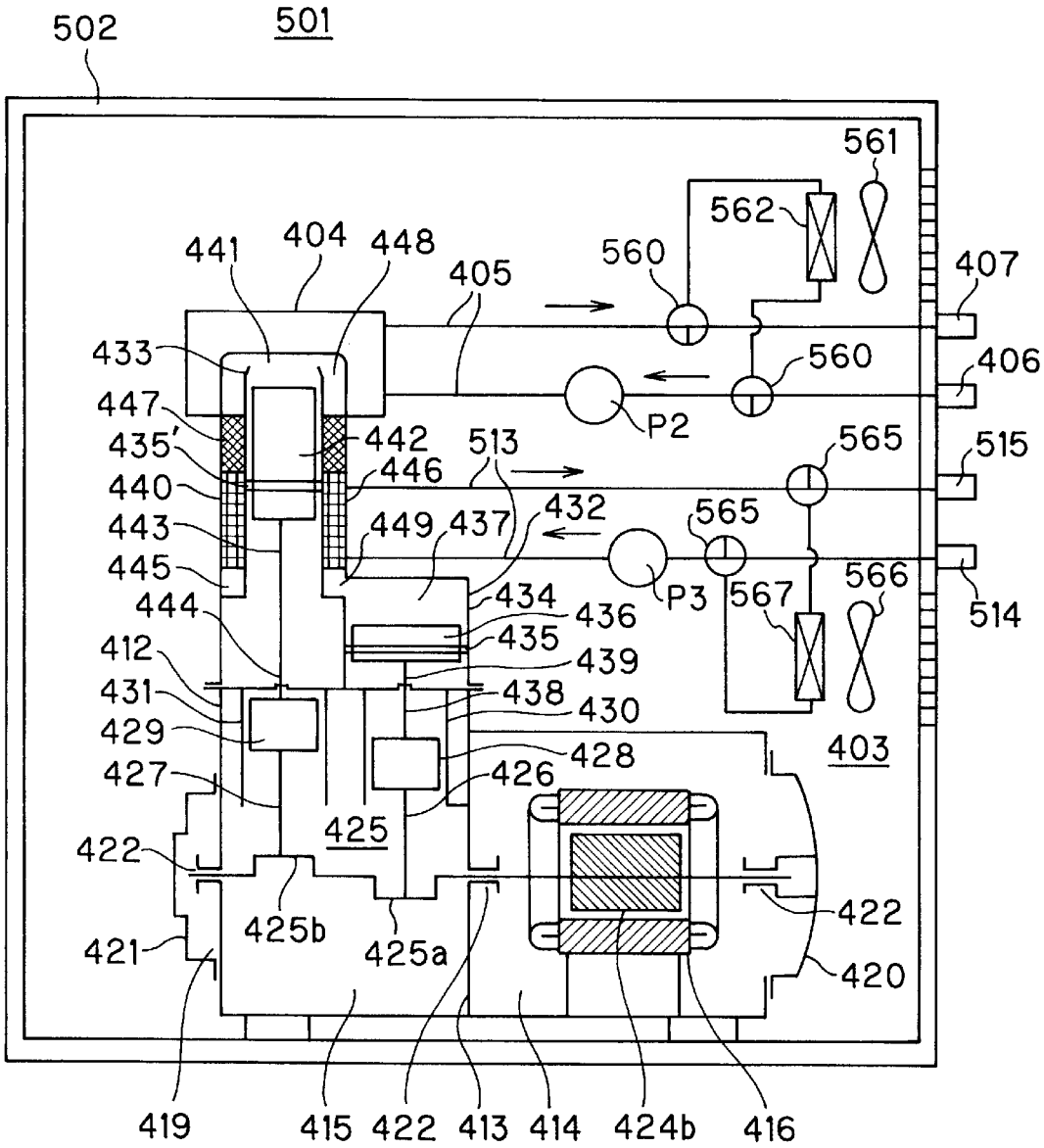
FIG. 26 is a diagram showing a Stirling cooling/heating machine used in the system of FIG. 25.

When only the cold-heat using equipment 408 is used in combination with the Stirling cooling/heating machine 501, the change-over valves 560 are kept as shown in FIGS. 25 and 26 to keep the cold-heat using equipment 408 usable. On the other hand, the change-over valves 565 are switched to circulate the hot-heat refrigerant between the heat rejector 446 and the radiator 567 and keep the hot-heat using equipment 516 unusable.

When only the hot-heat using equipment 516 is used in combination with the Stirling cooling/heating machine 501, the change-over valves 565 are kept as shown in FIGS. 25 and 26 to keep the hot-heat using equipment usable. On the other hand, by switching the change-over valves 560, the cold-heat refrigerant is circulated between the cold head 404 and the heat sink 562 and the cold-heat using equipment 408 is kept unusable.

The temperature of each of the cold-heat using equipment 408 and the hot-heat using equipment 516 is set by the temperature setting panel of the Stirling cooling/heating machine. The temperature set through the temperature set panel is compared with the temperature detection signal detected by the temperature sensor of each of the cold-heat using equipment 408 and the hot-heat using equipment 416 in the comparison circuit of the temperature control circuit to judge whether the set temperature is within the permissible temperature range containing the set temperature at the center thereof. In accordance with the judgment result, the motor 416 of the Stirling refrigerating machine 403 is subjected to the ON/OFF control or Inverter control, or the motor 416 is reversely rotated, thereby driving the cold-heat using equipment and the hot-heat using equipment while keeping the temperature of each equipment within the corresponding permissible temperature range.

When the Stirling cooling/heating machine 501 is used in combination with the cold-heat using equipment and the hot-heat using equipment 516 each of which is provided with an electric heater, in addition to the temperature control based on the driving control of the motor 446 of the Stirling refrigerating machine 403 as described above, the temperature detection signal from the temperature sensor and the set temperature are compared with each other in the controller, and then the electric heater is subjected to PID control on the basis of the comparison result, thereby performing more precise temperature control.

In the above embodiments, the 2-piston type Stirling refrigerating machine 403 is used, however, a displacer type Stirling refrigerating machine or other types of Stirling machines may be used.

According to the Stirling cooling machine and the Stirling cooling/heating machine of the above embodiments, the following effects can be achieved.

(1) The cooling/heating machine is constructed by using the Stirling refrigerating machine, and refrigerant having low melting point such as ethyl alcohol, nitrogen, helium, etc. other than flon (fluorocarbons) is used as working gas. Therefore, the cooling/heating machine can be used in a broader use temperature range than the conventional cooling/heating machine. Therefore, the cooling/heating machine is applicable to general-purpose cold-heat using equipment and/or hot-heat using equipment, and also there can be provided a Stirling cooling machine and/or Stirling cooling/heating machine which are suitable to avoid the global environmental problem.

(2) The Stirling machine of the present invention (Stirling cooling machine, Stirling cooling/heating machine) has the inlet cock and the outlet cock for each of the cold-heat refrigerant and the hot-heat refrigerant, and each of the cold-heat using equipment and the hot-heat using equipment is freely detachably connected to the refrigerant pipe of each of the cold-heat using equipment and the hot-heat using equipment, whereby the circulating passage for the refrigerant between the Stirling machine and each of the cold-heat using equipment and the hot-heat using equipment. Therefore, the Stirling machine of the present invention can be simply and generally applied to various kinds of cold-heat using equipment and hot-heat using equipment.

(3) The cold heat of the cold head of the Stirling refrigerating machine can be used for the cold-heat using equipment, and/or the hot-heat of the heat rejector can be used for the hot-heat using equipment, so that the cold heat and/or the hot heat produced can be effectively used to achieve a high COP (coefficient of performance).

(4) The driving motor of the Stirling refrigerating machine is subjected to ON/OFF control or inverter control or reversely rotated, whereby the temperature control can be performed. Further, by reversely rotating the motor of the Stirling refrigerating machine or performing the temperature control, not only the defrosting operation, but also the thermostatic cooling operation or the hot-heat using operation can be performed with a simple construction.

(5) According to the Stirling machine of the above embodiments, the Stirling refrigerating machine is designed in the 2-piston structure having the compression cylinder and the expansion cylinder, thereby increasing the volume variation of the space filled with the working gas in the Stirling refrigerating machine. Therefore, a Stirling refrigerating machine having large refrigerating power can be provided irrespective of the compact structure.

In all the above-described embodiments, ethyl alcohol, HFE (hydrofluoroether), PFC (perfluorocarbon), PFG (perfluorogrycol), oil (for heating), nitrogen, helium, water, etc. may be used as the heat exchange medium (cold-heat refrigerant, hot-heat refrigerant (secondary refrigerant)), and nitrogen, helium, water, etc. may be used as the working gas (primary refrigerant).

What is claimed is:

1. An improved Stirling machine of the type having a low-temperature side heat exchanger and a high-temperature side heat exchanger which perform cooling and heating operations through heat exchange between a working gas and a heat exchange medium, said low-temperature side heat exchanger comprising a top-side cylindrical heat exchange housing having a top wall and a side wall and containing therein an inner cylinder in which a piston or displacer of said Stirling machine is slid, said high-temperature side heat exchanger comprising a cylindrical annular heat exchange housing and a heat exchanger body which is fixedly inserted in said cylindrical annular heat exchange housing to form a flow passage for the heat exchange medium between said annular heat exchange housing and said heat exchanger body, wherein the improvement comprises:

a fin structure formed on at least the inner peripheral surface of at least one of said top-side heat exchange housing of said low-temperature side heat exchanger and said heat exchanger body of said high-temperature side heat exchanger, a flow passage for the working gas being formed between said fin structure and the outer peripheral surface of said inner cylinder, at least one of said top-side heat exchange housing, said annular heat exchange housing and said heat exchanger body being formed by casting, and a cold-heat exchange medium pipe through which the heat exchange medium cooled by said low-temperature side heat exchanger flows, an inlet cock disposed at one end of said cold-heat exchange medium pipe and an outlet cock disposed at the other end of said cold-heat exchange medium pipe, wherein by detachably connecting said outlet cock and said inlet cock to a cold-heat exchange medium pipe of a cold-heat using equipment, a circulating pipe line for the cooled heat exchange medium is formed between said Stirling machine and said cold-heat using equipment to feed cold heat to said cold-heat using equipment.

2. The Stirling machine as claimed in claim 1, wherein said fin structure formed on the inner peripheral surface of at least one of said top-side heat exchange housing and said heat exchanger body comprises slender grooves which are linearly formed in the axial direction of said inner cylinder, the working gas flow passage being formed between said slender grooves and the outer peripheral surface of said inner cylinder.

3. An improved Stirling machine of the type having a low-temperature side heat exchanger and a high-temperature side heat exchanger which perform cooling and heating operations through heat exchange between a working gas and a heat exchange medium, said low-temperature side heat exchanger comprising a top-side cylindrical heat exchange housing, having a top wall and a side wall and containing therein an inner cylinder in which a piston or displacer of said Stirling machine is slid, said high-temperature side heat exchanger comprising a cylindrical annular heat exchange housing and a heat exchanger body which is fixedly inserted in said cylindrical annular heat exchange housing to form a flow passage for the heat exchange medium between said annular heat exchange housing and said heat exchanger body, wherein the improvement comprises:

a fin structure formed on at least the inner peripheral surface of at least one of said top-side heat exchange housing of said low-temperature side heat exchanger and said heat exchanger body of said high-temperature side heat exchanger, a flow passage for the working gas being formed between said fin structure and the outer peripheral surface of said inner cylinder, and at least one of said top-side heat exchange housing, said annular heat exchange housing and said heat exchanger body being formed by casting, wherein said fin structure comprises an offset strip fin which is fixed onto at least the inner peripheral surface of said heat exchanger body so as to face said working gas flow passage.

4. The Stirling machine as claimed in claim 3, wherein an offset strip fin is fixed onto the outer peripheral surface of said heat exchanger body so as to face the heat exchange medium.

5. The Stirling machine as claimed in claim 3, wherein said fin structure is provided on the outer peripheral surface of at least one of said top-side heat exchange housing of said low-temperature side heat exchanger and said heat exchanger body of said high-temperature side heat exchanger, said fin structure being formed either integrally with at least one of said top-side heat exchanger and said heat exchanger body or separately therefrom and affixed to the outer peripheral surface.

6. The Stirling machine as claimed in claim 5, wherein said fin structure comprises a plurality of annular fins.

7. The Stirling machine as claimed in claim 3, further comprising a cold head disposed at the tip side of said top-side heat exchange housing of said low-temperature side heat exchanger, wherein said cold head has a heat-exchange medium flow passage which penetrates through the inside of said cold head and through which the heat exchange medium flows, and a fin structure is provided in said heat-exchange medium flow passage to enhance the heat exchange efficiency.

8. An improved Stirling machine of the type having a low-temperature side heat exchanger and a high-temperature side heat exchanger which perform cooling and heating operations through heat exchange between a working gas and a heat exchange medium, said low-temperature side heat exchanger comprising a top-side cylindrical heat exchange housing having a top wall and a side wall and containing therein an inner cylinder in which a piston or displacer of said Stirling machine is slid, said high-temperature side heat exchanger comprising a cylindrical annular heat exchange housing and a heat exchanger body which is fixedly inserted in said cylindrical annular heat exchange housing to form a flow passage for the heat exchange medium between said annular heat exchange housing and said heat exchanger body, wherein the improvement comprises:

a fin structure formed on at least the inner peripheral surface of at least one of said top-side heat exchange housing of said low-temperature side heat exchanger and said heat exchanger body of said high-temperature side heat exchanger, a flow passage for the working gas being formed between said fin structure and the outer peripheral surface of said inner cylinder, at least one of said top-side heat exchange housing, said annular heat exchange housing and said heat exchanger body being formed by casting, a cold head disposed at the tip side of said top-side heat exchange housing of said low-temperature side heat exchanger, wherein said cold head has a heat-exchange medium flow passage which penetrates through the inside of said cold head and through which the heat exchange medium flows, and wherein said fin structure comprises an offset strip fin provided in said heat-exchange medium flow passage to enhance the heat exchange efficiency.

9. The Stirling machine as claimed in claim 1, further comprising at temperature controller for controlling the driving power of said Stirling machine on the basis of a temperature detection signal from said cold-heat using equipment to thereby perform temperature control of said cold-heat using equipment.

10. The Stirling machine as claimed in claim 1, further comprising: a hot-heat exchange medium pipe through which the heat exchange medium heated by said high-temperature side heat exchanger flows, an inlet cock disposed at one end of said hot-heat exchange medium pipe and an outlet cock disposed at the other end of said hot-exchange medium pipe, wherein by detachably connecting said outlet cock and said inlet cock to a hot-heat exchange medium pipe of a hot-heat using equipment, a circulating pipe line for the heated heat exchange medium is formed between said Stirling machine and said hot-heat using equipment to feed hot heat to said hot-heat using equipment.

11. The Stirling machine as claimed in claim 10, further comprising a temperature controller for controlling the driving power of said Stirling machine on the basis of a temperature detection signal from said hot-heat using equipment to perform temperature control of said hot-heat using equipment, wherein said temperature controller is provided integrally with or separately from said temperature controller for said cold-heat using equipment.

12. The Stirling machine as claimed in claim 1, further comprising a defrosting control circuit for controlling a motor of said Stirling machine to be reversely rotated to thereby defrost at least one of said cold-heat using equipment and said low-temperature heat exchanger when occurrence of frost of at least one of said cold-heat using equipment and said low-temperature heat exchanger is detected.

13. An improved Stirling machine of the type having a low-temperature side heat exchanger and a high-temperature side heat exchanger which perform cooling and heating operations through heat exchange between a working gas and a heat exchange medium, said low-temperature side heat exchanger comprising a top-side cylindrical heat exchange housing having a top wall and a side wall and containing therein an inner cylinder in which a piston or displacer of said Stirling machine is slid, said high-temperature side heat exchanger comprising a cylindrical annular heat exchange housing and a heat exchanger body which is fixedly inserted in said cylindrical annular heat exchange housing to form a flow passage for the heat exchange medium between said annular heat exchange housing and said heat exchanger body, wherein the improvement comprises:

a fin structure formed on at least the inner peripheral surface of at least one of said top-side heat exchange housing of said low-temperature side heat exchanger and said heat exchanger body of said high-temperature side heat exchanger, and a flow passage for the working gas being formed between said fin structure and the outer peripheral surface of said inner cylinder, wherein at least one of said top-side heat exchange housing, said annular heat exchange housing and said heat exchanger body is formed by a lost wax casting method.

14. An improved Stirling machine of the type having a low-temperature side heat exchanger and a high-temperature side heat exchanger which perform cooling and heating operations through heat exchange between a working gas and a heat exchange medium, said low-temperature side heat exchanger comprising a top-side cylindrical heat exchange housing having a top wall and a side wall and containing therein an inner cylinder in which a piston or displacer of said Stirling machine is slid, said high-temperature side heat exchanger comprising a cylindrical annular heat exchange housing and a heat exchanger body which is fixedly inserted in said cylindrical annular heat exchange housing to form a flow passage for the heat exchange medium between said annular heat exchange housing and said heat exchanger body, wherein the improvement comprises:

a fin structure formed on at least the inner peripheral surface of at least one of said top-side heat exchange housing of said low-temperature side heat exchanger and said heat exchanger body of said high-temperature side heat exchanger, a flow passage for the working gas being formed between said fin structure and the outer peripheral surface of said inner cylinder, and at least one of said top-side heat exchange housing, said annular heat exchange housing and said heat exchanger body being formed by casting, wherein said fin structure is formed integrally with at least one of said top-side heat exchange housing and said exchanger body by a lost wax casting method.

15. The Stirling machine as claimed in claim 3, wherein at least one of ethyl alcohol, HFE (hydrofluoroether), PFC (perfluorocarbon), PFG (perfluorogrycol), oil (for heating), nitrogen, helium, and water is the heat exchange medium, and at least one of nitrogen, helium, and water is the working gas.

16. The Stirling machine as claimed in claim 1, wherein said fin structure is provided on the outer peripheral surface of at least one of said top-side heat exchange housing of said low-temperature side heat exchanger and said heat exchanger body of said high-temperature side heat exchanger, said fin structure being formed either integrally with at least one of said top-side heat exchanger and said heat exchanger body or separately therefrom and affixed to the outer peripheral surface.

17. The Stirling machine as claimed in claim 16, wherein said fin structure comprises a plurality of annular fins.

18. The Stirling machine as claimed in claim 1, further comprising a cold head disposed at the tip side of said top-side heat exchange housing of said low-temperature side heat exchanger, wherein said cold head has a heat-exchange medium flow passage which penetrates through the inside of said cold head and through which the heat exchange medium flows, and a fin structure is provided in said heat-exchange medium flow passage to enhance the heat exchange efficiency.

19. The Stirling machine as claimed in claim 1, wherein at least one of ethyl alcohol, HFE (hydrofluoroether), PFC (perfluorocarbon), PFG (perfluorogrycol), oil (for heating), nitrogen, helium, and water is the heat exchange medium, and at least one of nitrogen, helium, and water is the working gas.

* * * * *